US008043785B2

(12) United States Patent
Inoue et al.

(10) Patent No.: US 8,043,785 B2
(45) Date of Patent: Oct. 25, 2011

(54) CARRIER, METHOD FOR PRODUCING THE SAME, DEVELOPER, AND IMAGE FORMING METHOD

(75) Inventors: Ryota Inoue, Mishima (JP); Chiaki Tanaka, Izunokuni (JP); Masayuki Ishii, Numazu (JP); Yoshihiro Moriya, Numazu (JP); Shingo Sakashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 816 days.

(21) Appl. No.: 11/944,552

(22) Filed: Nov. 23, 2007

(65) Prior Publication Data

US 2008/0138734 A1 Jun. 12, 2008

(30) Foreign Application Priority Data

Dec. 7, 2006 (JP) ..... 2006-330443

(51) Int. Cl.
*G03G 9/113* (2006.01)

(52) U.S. Cl. ..... 430/137.13; 430/111.35

(58) Field of Classification Search ..... 430/137.13, 430/111.35

See application file for complete search history.

(56) References Cited

U.S. PATENT DOCUMENTS

| | | | | |
|---|---|---|---|---|
| 5,514,512 | A * | 5/1996 | Cunningham et al. | 430/137.13 |
| 5,514,514 | A * | 5/1996 | Cunningham et al. | 430/137.11 |
| 5,516,618 | A * | 5/1996 | Cunningham et al. | 430/137.13 |
| 2007/0031750 | A1* | 2/2007 | Tanaka et al. | 430/111.1 |
| 2007/0202427 | A1 | 8/2007 | Tanaka | |
| 2008/0063972 | A1* | 3/2008 | Inoue et al. | 430/111.1 |

FOREIGN PATENT DOCUMENTS

| | | | |
|---|---|---|---|
| JP | 55-127569 | | 10/1980 |
| JP | 55-157751 | | 12/1980 |
| JP | 56-140358 | | 11/1981 |
| JP | 57-96355 | | 6/1982 |
| JP | 57-96356 | | 6/1982 |
| JP | 58-207054 | | 12/1983 |
| JP | 61-110161 | | 5/1986 |
| JP | 62-273576 | | 11/1987 |
| JP | 9-269614 | | 10/1997 |
| JP | 9-319161 | | 12/1997 |
| JP | 10-186731 | | 7/1998 |
| JP | 2006-106208 | | 4/2006 |
| JP | 2006106208 | A * | 4/2006 |

OTHER PUBLICATIONS

Hay et al., "Review: Environmentally friendly coating using carbon dioxide as the carrier medium", Journal of Material Science, 37 (2002) pp. 4743-4752.*

English language machine translation of JP 2006-106208 (Apr. 2006).*

"Carbon Dioxide: Temperature—Pressure Diagram", ChemicaLogic Corp (1999).*

U.S. Appl. No. 11/853,520, filed Sep. 11, 2007, Inoue, et al.

* cited by examiner

*Primary Examiner* — Christopher Rodee

(74) *Attorney, Agent, or Firm* — Oblon, Spivak, McClelland & Neustadt, L.L.P.

(57) ABSTRACT

The present invention provides a method for producing a carrier that includes dissolving at least a coating material in carbon dioxide in a liquid state, and forming a coating layer on a core material surface by reducing the solubility of the liquid with at least the coating material dissolved therein through control of at least any one of the pressure and temperature. The present invention also provides a carrier produced by the method for producing a carrier.

15 Claims, 7 Drawing Sheets

CARRIER, METHOD FOR PRODUCING THE SAME, DEVELOPER, AND IMAGE FORMING METHOD

BACKGROUND OF THE INVENTION

1. Field of the Invention

The present invention relates to a method for producing a latent electrostatic image developing carrier that is favorably used for electrophotographic method, electrostatic recording method, and electrostatic printing method, and also relates to a method for producing the carrier, a developer using the carrier, and an image forming method using the developer.

2. Description of the Related Art

In a dry developing method used for electrophotography, a visible image is formed by making a toner frictioned with a charging member electrostatically adhered on a latent electrostatic image. In such a dry developing method, there are two types of developing methods. One is one-component developing method using a one-component developer composed of a toner, and another is two-component developing method composed of a glass bead, a magnetic carrier or a carrier covered with a resin etc. on the surface thereof, and a toner.

In a developer used in the two-component developing method, a fine toner is held on the surface of a relatively large core material by an electric force generated by friction between the toner and the core material. When the developer is closely situated on a latent electrostatic image, the toner overcomes a bonding force with the core material to thereby be developed on the latent electrostatic image. Then, the developer is repeatedly used while a toner consumed in developing being refilled. For this reason, the toner must be made to constantly have a desired polarity and must be frictionally charged with a sufficient charge amount on the core material during use of the core material. However, a toner fused on the surface of the core material, which is called "spent toner", by inter-particle collision and mechanical agitation between particles and a developing device used or heat generation, and thus the charging property of the core material degrades with use time. Consequently, background smear and toner scattering occur on images. Therefore, there is a need to entirely replace the developer.

To prevent occurrence of such a spent toner, there have been a number techniques of prolonging operation life of a carrier proposed so far by covering the surface of a core material with a resin having a low-surface energy such as a fluorine resin and a silicone resin. For example, a carrier covered with a room temperature curable silicone resin and a positively charged nitrogen resin (see Japanese Patent Application Laid-Open (JP-A) No. 55-127569), a carrier covered with a cover material containing at least one modified silicone resin (see Japanese Patent Application Laid-Open (JP-A) No. 55-157751), a carrier having a coating layer containing a room temperature curable silicone resin and a styrene-acrylic resin (see Japanese Patent Application Laid-Open (JP-A) No. 56-140358), a carrier in which the surface of a core particle is covered with two or more layers composed of a silicone resin so as not to have adhesion property between the layers (Japanese Patent Application Laid-Open (JP-A) No. 57-96355), a carrier in which the surface of a core particle is covered with multiple layers of a silicone resin (see Japanese Patent Application Laid-Open (JP-A) No. 57-96356), a carrier whose surface is covered with a silicone resin containing a silicon carbide (see Japanese Patent Application Laid-Open (JP-A) No. 58-207054), a positively charged carrier covered with a material exhibiting a critical surface tension of 20 dyn/cm or less (Japanese Patent Application Laid-Open (JP-A) No. 61-110161), and a developer containing a carrier covered with a coating material containing fluorine alkyl acrylate and a toner containing a chrome-contained azo dye (see Japanese Patent Application Laid-Open (JP-A) No. 62-273576).

Recently, to obtain a high-quality image, a toner tends to have a smaller diameter. As a result, a spent toner easily occurs onto a carrier. Further, with a conventional spray coating method, it is difficult to uniformly damp a carrier surface with a coating material. Therefore, it is difficult to produce a carrier having appropriate adhesion property between a coating layer and a core material and having a uniform thickness and uniform film quality. Further, in a case of a full-color toner, to obtain a sufficient color tone, a resin having a low-softening point is used. Accordingly, a full-color toner causes a carrier spent amount more than that of a black toner, and the toner charge amount is reduced to cause toner scattering and background smear. As described above, a full-color electrophotographic system has a problem that when the toner charge amount is reduced, the image density particularly in highlight parts is easily changed and a high-image quality cannot be maintained.

Further, to improve the durability of a carrier, technique are proposed in which a coating layer is formed in which a fine particle and a conductivity imparting material are dispersed in the resin matrix of a low-surface energy material to thereby control the spent resistance, film strength, and electric properties (see Japanese Patent Application Laid-Open (JP-A) Nos. 9-319161, 9-269614 and 10-186731). However, these proposals have a problem that the toner charge amount is hardly uniformized due to flocculated fine particles etc. because a dispersion prepared by adding the fine particles into an organic solvent is spray-coated at a high temperature.

Furthermore, conventional spray-coating methods have a production problem that it is necessary to clear the regulation of volatile organic compounds (VOC) and waste water that could be produced in an organic solvent used in forming a coating layer on the surface of a core material, and thus a dry energy is required. To address these problems, a method of producing a carrier is proposed which uses a supercritical fluid in a dry powder process without using, for example, an organic solvent (see U.S. Pat. No. 5,514,512). However, the proposal cannot solve the above-mentioned problem with a spent toner, because in the proposal, a coating resin polymerized in a supercritical fluid is heated and fused in a supercritical fluid and the surface of a core material is covered with the fluid.

Further, in a method of producing a carrier using a supercritical fluid described in Japanese Patent Application Laid-Open (JP-A) No. 2006-106208, a silicone resin is used as a coating material, but the solubility of the silicone resin to the supercritical fluid is insufficient, and then a plasticized and finely dispersed silicone resin is sprayed together with a core material, thereby coating the surface of a core material. As a result, the obtainable coating layer is poor in thickness uniformity, and the method has a problem that it is impossible to form a coating layer having a thickness required to satisfy the durability.

Accordingly, there has not yet been provided a carrier that has a coating layer having a uniform and appropriate thickness on the surface of a core material and has a high adhesion property between the core material and the coating layer and sufficiently satisfiable related techniques thereof. Further, from the perspective of environmental burden and resource-saving, the current situation is that conventional methods of producing a carrier and conventional carriers have various problems to solve.

BRIEF SUMMARY OF THE INVENTION

The present invention aims to provide a latent electrostatic image developing carrier that has a coating layer on a core material surface, wherein the coating layer has a uniform thickness and a high-adhesion property with the core material, and also aims to provide a method for producing the carrier, a developer using the carrier, which is capable of forming a high-quality image at a high-image density without substantially causing toner scattering and background smear, and an image forming method using the developer.

The means to solve the aforementioned problems are as follows:

<1> A method for producing a carrier including dissolving at least a coating material in carbon dioxide in a liquid state, and forming a coating layer on a core material surface by reducing the solubility of the liquid with at least the coating material dissolved therein through control of at least any one of the pressure and temperature.

<2> The method for producing a carrier according to the item <1>, wherein the pressure used in the dissolution is 7.38 MPa or more.

<3> The method for producing a carrier according to the item <1>, wherein in the formation of the coating layer, the carbon dioxide in a liquid state is changed to carbon dioxide in a supercritical or subcritical state.

<4> The method for producing a carrier according to the item <1>, wherein in the formation of the coating layer, the pressure is reduced to an atmospheric pressure.

<5> The method for producing a carrier according to the item <1>, wherein in the formation of the coating layer, the temperature of the liquid with at least the coating material dissolved therein is raised to 31° C. or more.

<6> A carrier, containing a core material, and a coating layer, wherein the carrier is produced by a method for producing a carrier that contains dissolving at least a coating material in carbon dioxide in a liquid state, and forming the coating layer on the surface of the core material by reducing the solubility of the liquid with at least the coating material dissolved therein through control at least any one of the pressure and temperature.

<7> A developer containing a carrier, and a toner, wherein the carrier is produced by a method for producing a carrier that contains dissolving at least a coating material in carbon dioxide in a liquid state, and forming a coating layer on a core material surface by reducing the solubility of the liquid with at least the coating material dissolved therein through control of at least any one of the pressure and temperature.

<8> An image forming method including at least forming a latent electrostatic image on a latent electrostatic image bearing member, developing the latent electrostatic image using a developer to form a visible image, transferring the visible image onto a recording medium, and fixing the transferred image on the recording medium, wherein the developer contains a carrier and a toner, and wherein the carrier is produced by a method for producing a carrier that includes dissolving at least a coating material in carbon dioxide in a liquid state, and forming a coating layer on a core material surface by reducing the solubility of the liquid with at least the coating material dissolved therein through control of at least any one of the pressure and temperature.

<9> An image forming apparatus having at least a latent electrostatic image bearing member, a latent electrostatic image forming unit configured to form a latent electrostatic image on the latent electrostatic image bearing member, a developing unit configured to develop the latent electrostatic image using a developer to form a visible image, a transfer unit configured to transfer the visible image onto a recording medium, and a fixing unit configured to fix the transferred image on the recording medium, wherein the developer contains a carrier, and a toner, wherein the carrier is produced by a method for producing a carrier that contains dissolving at least a coating material in carbon dioxide in a liquid state, and forming a coating layer on a core material surface by reducing the solubility of the liquid with at least the coating material dissolved therein through control of at least any one of the pressure and temperature.

<10> A process cartridge having at least a latent electrostatic image bearing member, and a developing unit configured to develop a latent electrostatic image formed on the latent electrostatic image bearing member using a developer to form a visible image, wherein the developer contains a carrier, and a toner, wherein the carrier is produced by a method for producing a carrier that contains dissolving at least a coating material in carbon dioxide in a liquid state, and forming a coating layer on a core material surface by reducing the solubility of the liquid with at least the coating material dissolved therein through control of at least any one of the pressure and temperature.

The method for producing a carrier of the present invention includes a dissolution step and a coating layer formation step. In the dissolution step, at least a coating material is dissolved in carbon dioxide in a liquid state. Next, in the coating layer formation step, the solubility of the liquid with at least the coating material dissolved therein is reduced by controlling at least any one of pressure and temperature, thereby forming a coating layer on the core material surface. As a result, even with use of a resin that is poor in solubility, it is possible to efficiently produce a carrier that has a coating layer having a uniform thickness, a high-adhesion property with the core material, and a high-mechanical strength and is excellent in toner chargeability and storage stability with time. The method for producing a carrier of the present invention is based on a dry process, makes it possible to clear the regulation of volatile organic compounds (VOC) without substantially causing waste water, and also makes it possible to extremely efficiently produce a carrier without the necessity of a substantial amount of dry energy.

The developer of the present invention contains the carrier of the present invention and a toner. By using the developer, an image can be formed with a high-image density without substantially causing toner scattering and background smear.

The image forming method of the present invention includes at least a latent electrostatic image forming step, a developing step, a transfer step, and a fixing step. In the image forming method of the present invention, a latent electrostatic image is formed on a latent electrostatic image bearing member in the latent electrostatic image forming step. The latent electrostatic image is developed using the developer of the present invention and a visible image is formed in the developing step. The visible image is transferred onto a recording medium in the transfer step. The transferred image is fixed on the recording medium in the fixing step. As a result, a high-quality image can be obtained with a high-image density and high-sharpness while maintaining a high-mechanical strength, without substantially causing toner scattering and background smear.

DETAILED DESCRIPTION OF THE INVENTION

Carrier Production Method and Carrier

Figure 1:
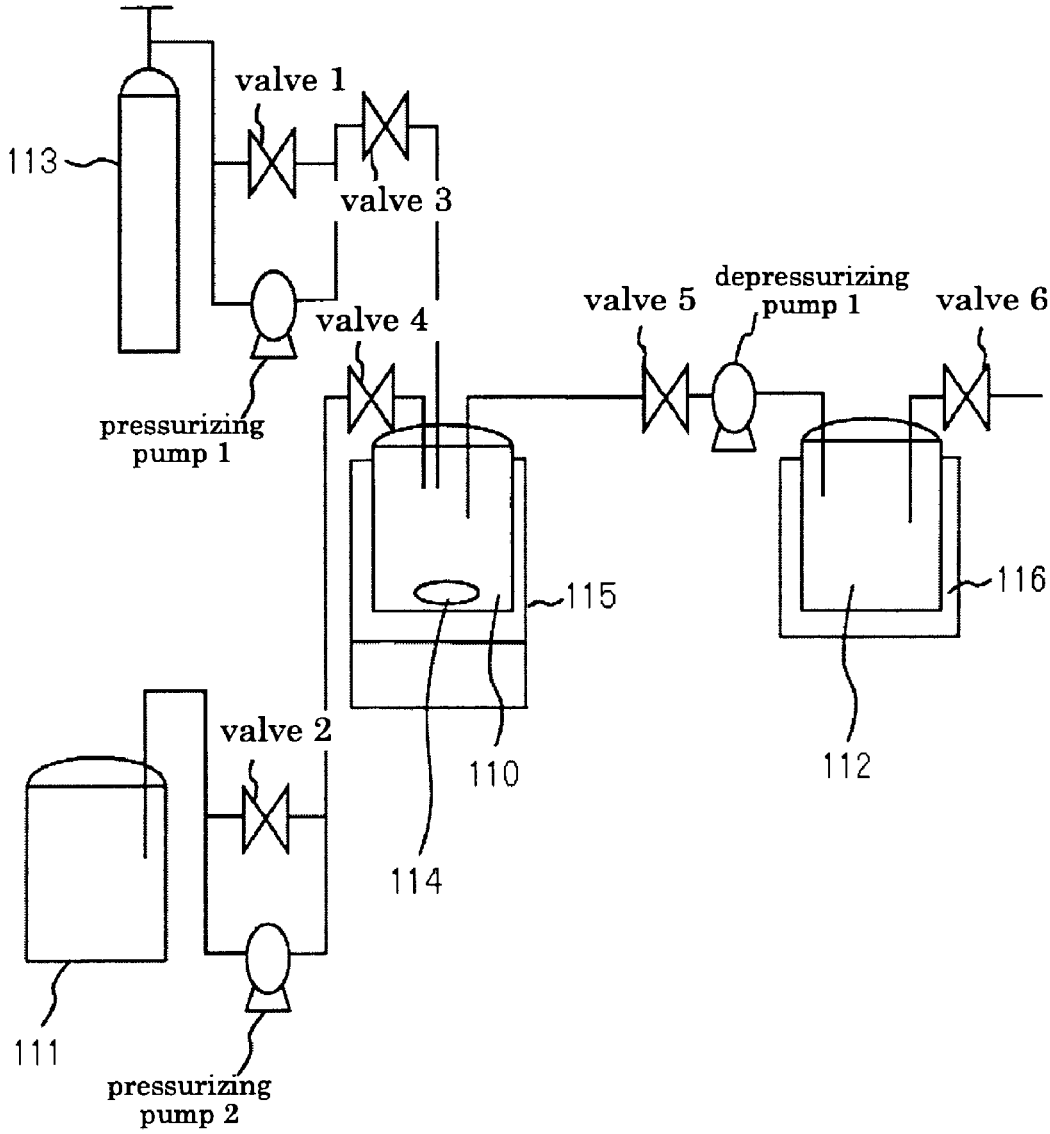
FIG. 1 is a schematic view showing one example a device used for the method of producing a carrier of the present invention.

The method for producing a carrier of the present invention includes a dissolution step and a coating layer forming step and further includes other steps in accordance with necessity.

The carrier of the present invention is produced by the method for producing a carrier of the present invention.

Hereinafter, details of the carrier of the present invention will be clarified with explanation of the method for producing a carrier of the present invention.

<Dissolution Step>

The dissolution step is a step in which at least a coating material is dissolved in carbon dioxide in a liquid state. Specifically, carbon dioxide in a liquid state is used as a solvent for the coating material. By using carbon dioxide in a liquid state as a solvent as described above, the solubility to the coating material is improved, thereby forming a coating layer having a desired thickness with ease.

Here, the carbon dioxide in a liquid state means carbon dioxide in a liquid state prepared under application of pressure and heat and does not include carbon dioxide in a supercritical or subcritical state.

The carbon dioxide has a supercritical pressure of 7.38 MPa and a supercritical temperature of 31° C., can be easily in a supercritical state, and is a nonflammable, highly safe and non-aqueous solvent. Therefore, by using the carbon dioxide, a carrier having a hydrophobic surface can be obtained. Further, the carbon dioxide can be gasified by only restoring it to the normal pressure (by releasing the applied pressure) and thus it can be easily collected and recycled. Furthermore, the carbon dioxide is particularly preferable because it is not harmful to the global environment in terms that the obtained carrier needs no drying, and no waste water is produced.

The pressure used in the dissolution step is preferably equivalent to or higher than the supercritical pressure of the carbon dioxide (7.38 MPa or more) and more preferably 8.0 MPa to 40.0 MPa. The temperature used in the dissolution step is preferably 30° C. or less and more preferably −30° C. to 30° C.

In addition to the carbon dioxide, another fluid can be used in combination. For the another fluid, the one that can easily control the solubility of the coating material is preferable. Specifically, methane, ethane, propane, and ethylene are preferably exemplified.

Further, in addition to the carbon dioxide, an entrainer can also be added to the solvent. The solubility of the coating material can be improved by adding the entrainer. By adding the entrainer, the solubility of the coating material can be improved. The entrainer is not particularly limited and may be suitably selected in accordance with the intended use, however, a polar organic solvent is preferable. Examples of the polar organic solvent include methanol, ethanol, propanol, butanol, hexane, toluene, ethyl acetate, chloroform, dichloromethane, ammonia, melamine, urea, and thioethylene glycol. Of these, a lower alcohol solvent that exhibits poor solvent property under the condition of normal temperature and normal pressure and has 1 to 6 carbon atoms (preferably, has 1 to 4 carbon atoms) is preferable.

<Coating Layer Forming Step>

The coating layer forming step is a step in which the solubility of a liquid with at least a coating material dissolved therein is reduced by controlling at least any one of pressure and temperature to thereby form a coating layer on the surface of a core material.

In the coating layer forming step, it is preferable to change the carbon dioxide in a liquid state to carbon dioxide in a supercritical or subcritical state in terms of improvement of adhesion property between the core material and a coating layer in forming the coating layer.

Here, the carbon dioxide in a supercritical or subcritical state means carbon dioxide that can exist as a noncondensable high-density fluid in temperature and pressure ranges exceeding critical points, and cannot be condensed even when densified, and is in a state of the supercritical pressure or more.

To reduce the solubility of the liquid with the coating material dissolved therein, the pressure is reduced to an atmospheric pressure. Specifically, the temperature of the liquid with the coating material dissolved therein is raised to a temperature equivalent to or higher than the supercritical temperature of carbon dioxide (31° C. or more), and then the pressure thereof is reduced to the atmospheric pressure. With this process, a coating layer can be efficiently formed on the core material surface.

Note that in the coating layer forming step, the pressure of the carbon dioxide in a liquid state may be reduced to an atmospheric pressure in a condition where the liquid state is maintained as it is, without changing the carbon dioxide in a liquid state to carbon dioxide in a supercritical or subcritical state.

Next, a device used in the method for producing a carrier of the present invention is not particularly limited and may be suitably selected in accordance with the intended use. For example, a device is preferably exemplified which is equipped with at least a pressure-proof vessel used to dissolve a coating material and a pressurizing pump used to supply the carbon dioxide in a liquid state. In a treatment using the device, first, at least a coating material is put in the pressure-proof vessel, the carbon dioxide in a liquid state is supplied to the pressure-proof vessel using the pressurizing pump to dissolve the coating material in the carbon dioxide in a liquid state. Next, the pressure of the carbon dioxide in a liquid state is reduced and the pressure and the temperature of the carbon dioxide are restored to the normal pressure and normal temperature, and then the solubility of the coating material is reduced to thereby form a coating layer on the surface of the core material. Because the carbon dioxide in a liquid state becomes a gas as stated above, there is no need to remove the solvent, further waste water that could be produced in washing is not produced, thereby reducing the burden to environments.

Here, in the method for producing a carrier of the present invention, a coating layer can be formed on the surface of a core material using an apparatus shown in FIG. 1, for example.

The apparatus shown in FIG. 1 will be now explained below. In a carrier treatment tank 110, a coating material and a core material are put, a valve 3 is opened while stirring the components with a stirrer 114, carbon dioxide is supplied from a carbon dioxide cylinder 113 by means of a pressurizing pump 1, the pressure and the temperature of the pressurizing pump 1 is set at 25 MPa and 15° C., and then the valve 3 is closed. The inside of the carrier treatment tank 110 is kept at 25 MPa and 15° C. for 2 hours, then a valve 5 and a valve 6 are opened, the inside of the carrier treatment tank 110 is increased in temperature to 40° C., and then the valves 5 and 6 are closed.

Next, the inside of the carrier treatment tank 110 is kept at 25 MPa and 40° C. for 0.5 hours, then the valves 5 and 6 are opened, and the pressure of the inside of the carrier treatment tank 110 is restored to the normal pressure range by means of a depressurizing pump 1 for 2 hours. Further, the inside of the carrier treatment tank 110 is heated at 160° C. for 2 hours to thereby produce a carrier. A coating material and a core material that have not been used can be collected and recycled from both the carrier treatment tank 110 and a raw material collection tank 112.

Further, in accordance with necessity, an entrainer may be supplied to the carrier treatment tank 110 from an entrainer tank 111 by means of a pressurizing pump 2. Thereafter, a valve 2 and a valve 4 may be closed.

Note that in FIG. 1, a reference numeral 115 denotes a thermostat jacket, and a reference numeral 116 denotes a cooling jacket.

<Coating Layer>

The coating layer contains at least a coating material and further contains other components in accordance with necessity.

—Coating Material—

The coating material (hereinafter, may be referred to as "coating resin") is not particularly limited and may be suitably selected from among conventional resins in accordance with the intended use. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acryl monomer, copolymers of vinylidene fluoride and vinyl fluoride, fluoro terpolymers such as terpolymers of tetrafluoroethylene, vinylidene fluoride and nonfluorinated monomer (fluoride tri (multi) copolymers), and silicone resins. Each of these coating materials may be used alone or in combination with two or more. Of these, silicone resins are particularly preferable from the perspective that they exhibit an excellent effect.

The silicone resin is not particularly limited and may be suitably selected from among generally known silicone resins. For example, straight silicone resins represented by the following Structural Formula (1) are preferable.

Structural Formula (i)

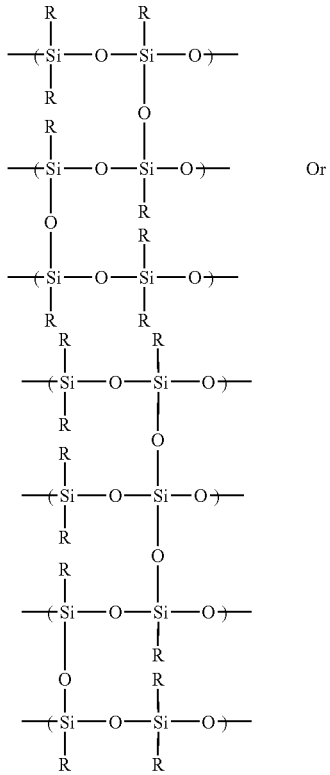

In Structural Formula (i), R represents a hydrogen atom, a hydroxyl group, an alkoxy group, an alkyl group, an aryl group or an amino group.

Examples of the alkoxy group include methoxy group and ethoxy group.

Examples of the alkyl group include methyl group, ethyl group, and propyl group.

Examples of the aryl group include phenyl group, tolyl group, and xylyl group.

Examples of the amino group include aminopropyl group, iminopropyl group, and aminophenoxymethyl group.

The mass average molecular mass of the silicone resin is not particularly limited and may be suitably selected in accordance with the intended use, however, it is preferably 500 to 100,000 and more preferably 1,000 to 10,000.

Here, the mass average molecular mass of the silicone resin can be measured by the following method.

Gel Permeation Chromatography (GPC) measurement device: GPC-8220-GPC (manufactured by TOSOH CORPORATION)

Column: TSKgel SuperHZM-H 15 cm three-throw (manufactured by TOSOH CORPORATION)

Temperature: 40° C.

Solvent: tetrahydrofuran (THF)

Flow rate: 0.35 mL/min

Sample: 0.4 mL of 0.15% by mass of sample is injected.

Pretreatment of sample: 0.15% by mass of a toner is dissolved in tetrahydrofuran (THF: manufactured by Wako Pure Chemical Industries, Ltd.) and then the solution is filtrated through a 0.2 μm filter to prepare a filtrate. The filtrate is used as a sample solution.

Thereafter, 100 μL of the sample solution is injected in the GPC measurement device to measure the molecular mass of the sample solution. In the measurement of the molecular mass of the sample, a molecular mass distribution of the sample is calculated based on a relation between logarithmic values from an analytical curve prepared using several types of monodispersed polystyrene standard samples and the number of counted molecules. In other words, the molecular mass of the sample is calculated based on the polystyrene equivalent molecular mass. As standard polystyrene samples used for preparation of an analytical curve, toluenes of SHOWDEX STANDARD STD. Nos. S-7300, S-210, S-390, S-875, S-1980, S-10.9, S-629, S-3.0, and S-0.580 manufactured y SHOWA DENKO K.K. are used. As a detector, an R1 (refractive index) detector is used.

For the silicone resin used as the coating resin, it is preferable to use a silicon resin in a solid state at 25° C. under normal pressure than to use a silicone resin in a liquid state under the same condition, in that a solid silicone resin is excellent in handleability, film formability, and film thickness controllability. Here, the normal pressure indicates a pressure under a standard condition. In the present invention, the normal pressure is 0.1 MPa.

In order to make the formed film crosslinked, the silanol concentration of the silicone resin is preferably 1% by mass to 40% by mass, more preferably 1% by mass to 20% by mass, and still more preferably 1% by mass to 10% by mass. When the silanol concentration is more than 40% by mass, a crosslinked film easily becomes brittle because of its hardness, the durability of the crosslinked film degrades, and an unreacted silanol group remains. Accordingly, the environmental stability of the carrier may degrade. In contrast, when the silanol concentration is less than 1% by mass, the coating performance as a coating resin may degrade.

The silicone resin is not particularly limited, and a suitably synthesized silicone resin may be used, or a commercially available product may be used. Examples of the commercially available product include, as straight silicone resins, KR271, KR255, KR220L, and KR152 manufactured by Shin-Etsu Chemical Co., Ltd.; SR2400, SR2406, SR2410, SR213, SR217, FLAKE RESIN 220, FLAKE RESIN 233, FLAKE RESIN 249, and FLAKE RESIN Z-6018 INTERMEDIATE.

For the silicone resin, a modified silicone resin can also be used. Examples of the commercially available products of the modified silicone resin include KR206 (alkyd modified), KR5208 (acryl modified), ES1001N (epoxy modified), KR305 (urethane modified) manufactured by Shin-Etsu Chemical Co., Ltd; SR2115 (epoxy modified), SR2110 (alkyd modified), SF8417, BY16-850 and BY16-872 (amino modified) manufactured by DOW CORNING TORAY SILICONE CO., LTD.

The silicone resin can also be used as a monomer and can also be used together with the crosslinkable components or charge amount controlling components and the like. Examples of the crosslinkable components include silane coupling agents. Examples of the silane coupling agents include methyl trimethoxy silane coupling agents, methyl triethoxy silane coupling agents, octyl trimethoxy silane coupling agents and aminosilane coupling agents.

For the aminosilane coupling agents, compounds represented by the following formulas are preferably exemplified. The content of the aminosilane coupling agent is preferably 0.001% by mass to 30% by mass and more preferably 0.001% by mass to 15% by mass. By adding an aminosilane coupling agent to the coating layer, the storage stability with time and the durability of the carrier can be improved.

| | |
|---|---|
| $H_2N(CH_2)_3Si(OCH_3)_3$ | MW 179.3 |
| $H_2N(CH_2)_3Si(OC_2H_5)_3$ | MW 221.4 |
| $H_2NCH_2CH_2CH_2Si(CH_3)_2(OC_2H_5)$ | MW 161.3 |
| $H_2NCH_2CH_2CH_2Si(CH_3)(OC_2H_5)_2$ | MW 191.3 |
| $H_2NCH_2CH_2NHCH_2Si(OCH_3)_3$ | MW 194.3 |
| $H_2NCH_2CH_2NHCH_2CH_2CH_2Si(CH_3)(OCH_3)_2$ | MW 206.4 |
| $H_2NCH_2CH_2NHCH_2CH_2CH_2Si(OCH_3)_3$ | MW 224.4 |
| $(CH_3)_2NCH_2CH_2CH_2Si(CH_3)(OC_2H_5)_2$ | MW 219.4 |
| $(C_4H_9)_2NC_3H_6Si(OCH_3)_3$ | MW 291.6 |

—Fine Particle—

A fine particle can be added to the coating layer in accordance with necessity. The fine particle is not particularly limited and may be suitably selected from among those known as two-component carriers for electrophotography. For example, inorganic fine particles such as metal powders and various metal oxide particles are preferably used. Of these, a metal oxide particle of silicone oxide, titanium oxide or alumina allows for easily obtaining a particle having a uniform fine particle diameter and obtaining various electric properties and mechanical strength depending on the type of particle to be used. Further, in the course of condensation curing of the silicone resin, it is important that the fine particle is thermally stable even when the carrier is heated at high-temperature.

Further, for the purpose of controlling electric resistivity of the carrier, the coating layer may contain fine particles, for example, a metal powder of conductive ZnO, Al, etc.; $SnO_2$ prepared by various methods or $ZnO_2$ doped with various elements; borides (for example, $TlB_2$, $ZnB_2$, and $MoB_2$); silicon carbides, conductive polymers (for example, polyacetylene, polyparaphenylene, poly(paraphenylene sulfide), polypyrrole, parylene, etc.), and carbon black.

The additive amount of the fine particle is preferably 1 part by mass to 100 parts by mass and more preferably 1 part by mass to 70 parts by mass to 100 parts by mass of the coating resin.

A most suitable silicone resin used in the coating layer is known that it has high-electric resistivity and generally has high-resistivity. For this reason, as a resistivity adjustor to be added in the coating layer, it is preferable to use at least one particle having a volume resistivity of $10^{-6}$ Ω·cm or less. It is important that such a conductive fine particle has a sufficiently small particle diameter to the coating layer and can be evenly dispersed in the coating layer. This is important to exert expected effects of uniformization of chargeability, toner maintaining property and developing property by the configuration of the coating layer. It is unfavorable that the convexoconcave form of the coating layer is disturbed by introduction of these conductive fine particles. Examples of materials satisfying these conditions include metal oxide fine particles or carbon blacks that are respectively subjected to a conductive treatment.

Further, when a material having an extremely low-resistivity such as carbon black is dispersed in the coating layer for use, the electric properties of the coating layer sensitively vary to the content of the carbon black, and thus there is a need to pay attention to the handling. For example, the use of carbon black associates with handling difficulties as follows. The electric resistance between carrier particles easily becomes uneven, and the physical properties of the obtained carrier are hardly stabilized against a slight change in production process. These problems can be avoided by accurately controlling the content of carbon black to be used and uniformizing the dispersibility of components in the coating layer, however, as the electric resistivity controlling material contained in the coating layer, a conductive carbon particle and a fine particle of a non-conductive metal oxide may be mixed for use.

—Core Material—

The core material is not particularly limited and may be suitably selected from among core materials known as two-component carrier for electrophotography. For example, ferrite, magnetite, iron, and nickel are preferably exemplified. In consideration of environmental aspects that have become remarkably advanced, for example, Mn ferrite, Mn—Mg ferrite, Mn—Mg—Sr ferrite and the like are preferably used, not using conventional copper-zinc ferrite.

From the viewpoint of preventing carrier adhesion to a latent electrostatic image bearing member (preventing a carrier from scattering), the core material preferably has a volume average particle diameter of 20 μm or more, from the viewpoint of preventing image degradation such as preventing occurrence of carrier streaks, it preferably has a volume average particle diameter of 100 μm or less, and from the viewpoint of achieving high-quality image formation in recent years, it preferably has a volume average particle diameter of 20 μm to 50 μm.

Here, the volume average particle diameter of the core material can be measured by using a "MICRO TRACK PARTICLE SIZE ANALYZER SRA" (manufactured by NIKKISO CO., LTD.) and setting the range of volume average particle diameter of 0.7 μm to 125 μm.

When the obtained carrier is used in a two-component developer, the LogR of the electric resistivity measured value is preferably 7 Ω·cm to 16 Ω·cm. The electric resistivity can be suitably selected according to developing process in which the carrier is used. When the LogR is less than 7 Ω·cm, the form of a carrier standing on a developer bearing member (magnetic brush) may be contrasted and shaded to become conspicuous. In contrast, the LogR is more than 16 Ω·cm, an image density difference between an edge part and a solid part in an image and an image density difference between a line-image and a solid image may occur. Further, this may easily cause degradation in developing ability in edge parts, degradation in developing ability by charge-up in the carrier, and adhesion of carrier to non-image parts such as latent image.

Here, the electric resistivity of the carrier is a value that can be determined, for example, from a current value and an applied voltage when a carrier is supplied in between two parallel electrodes and setting a potential difference between the two parallel electrodes. Specifically, a vessel having two electrodes placed in parallel at 2 mm intervals is filled with a carrier, a direct current resistivity with a potential difference of 50V in between the electrodes is measured by using 4329A HIGH RESISTANCE METER manufactured by Hewlett-Packard Development Co., L.P.

Further, it is preferable that the thickness of the coating layer in the carrier be suitably set so that the electric resistivity is within an appropriate range, however, as the thickness of the coating layer is increased, it may suffer shortcomings that a reaction inside the coating layer is liable to be nonuniform because silicone has a volume shrinkage in a condensation reaction. Therefore, the thickness of the coating layer is preferably 1.0 μm or less and more preferably 0.02 μm to 0.8 μm.

Here, the thickness of the coating layer can be measured by using, for example, a transmission electron microscope (TEM) and observing a cross-section of the carrier.

(Developer)

The developer of the present invention is a two-component developer containing the carrier of the present invention and a toner.

The mixing ratio of the toner and the carrier in the developer is preferably 1.0 part by mass to 10.0 parts by mass of the toner to 100 parts by mass of the carrier.

The toner contains at least a binder resin and a colorant, contains a releasing agent and a charge controlling agent, and further contains other components in accordance with necessity.

<Toner>

The method for producing a toner is not particularly limited and may be suitably selected in accordance with the intended use. There are pulverization method; and suspension polymerization method, emulsification polymerization and polymer suspension method in which an oil phase is emulsified, suspended or is made to flocculate in an aqueous medium to thereby form a toner base particle.

—Binder Resin—

The binder resin is not particularly limited and may be suitably selected from conventional binder resins in accordance with the intended use. Examples thereof include styrenes such as polystyrene, poly-p-styrene, and polyvinyl toluene or monopolymer of substitution products thereof; styrene copolymers such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl methylethylketone copolymer, styrene-butadiene copolymer, styrene-isopropyl copolymer, and styrene-maleate ester copolymer; polymethyl methacrylate resins, polybutyl methacrylate resins, polyvinyl chloride resins, polyvinyl acetate resins, polyethylene resins, polyester resins, polyurethane resins, epoxy resins, polyvinyl butyral resins, polyacrylate resins, rosin resins, modified rosin resins, terpene resins, phenol resins, aliphatic or aromatic hydrocarbon resins, and aromatic petroleum resins. Each of these binder resins may be used alone or in combination with two or more.

—Colorant—

The colorant is not particularly limited and may be suitably selected from among conventional dyes and pigments in accordance with the intended use. Examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone. Each of these colorants may be used alone or in combination with two or more. The content of the colorant in the toner is preferably 1% by mass to 15% by mass and more preferably 3% by mass to 10% by mass.

The colorant(s) may be used as a masterbatch that is complexed with resin(s). The resin is not particularly limited and may be suitably selected from among those known in the art in accordance with the intended use. Examples thereof include styrenes or polymers of substitution products thereof, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethanes, polyamides, polyvinyl butyrals, polyacrylate resins, rosins, modified rosins, terpene resins, aliphatic hydrocarbon resins, alicyclic hydrocarbon resins, aromatic petroleum resins, chlorinated paraffins and paraffins. Each of these resins may be used alone or in combination with two or more.

—Releasing Agent—

The releasing agent is not particularly limited and may be suitably selected from conventional releasing agents in accordance with the intended use. Preferred examples thereof include waxes.

Examples of the waxes include carbonyl group-containing waxes, polyolefin waxes, and long-chain hydrocarbons. Each of these waxes may be used alone or in combination with two or more. Of these, carbonyl group-containing waxes are preferable. Examples of the carbonyl-group containing waxes include polyalkane esters, polyalkanol esters, polyalkaneamides, polyalkylamides, and dialkylketones. Examples of the polyalkane esters include carnauba wax, montan wax, trimethylol propane tribehenate, pentaerythritol tetrabehenate, pentaerythritol diacetate dibehenate, glycerine tribehenate and 1,18-octadecanediol distearate. Examples of the polyalkanol esters include trimellitic tristearyl and distearyl maleate. Examples of the polyalkane amides include dibehenylamide. Examples of the polyalkylamide include trimellitic acid tristearylamide. Examples of the dialkylketone include distearyl ketone. Of these carbonyl group-containing waxes, polyalkane esters are particularly preferable.

Examples of the polyolefine waxes include polyethylene waxes and polypropylene waxes.

Examples of the long-chain hydrocarbons include paraffin waxes and sazol waxes.

The melting point of the releasing agent is not particularly limited and may be suitably adjusted in accordance with the intended use, however, it is preferably 40° C. to 160°, more preferably 50° C. 120°, and still more preferably 60° C. to 90° C. When the melting point of the releasing agent is lower than 40° C., it may adversely affect the heat resistance/storage stability of the toner, and when higher than 160° C., cold-offset may easily occur at the time of fixing an image at a low-temperature.

The melt viscosity of the releasing agent as a value measured at a temperature 20° C. higher than the melting point of the wax, is preferably 5 cps to 1,000 cps and more preferably 10 cps to 100 cps.

When the melt viscosity of the releasing agent is lower than 5 cps, the releasing property of the toner may degrade, and when higher than 1,000 cps, an effect of promoting hot-offset resistance and low-fixing property may not be obtained.

The content of the releasing agent in the toner is not particularly limited and may be suitably selected in accordance with the intended use, however, it is preferably 1% by mass to 40% by mass and more preferably 3% by mass to 30% by mass.

When the content is more than 40% by mass, the flowability of the toner may degrade.

—Charge Controlling Agent—

The charge controlling agent is not particularly limited, and a positive or negative charge controlling agent can be suitably selected depending on a positive charge or a negative charge to be used to charge a photoconductor.

For the negative charge controlling agent, it is possible to use for example, a resin or a compound having an electron donating functional group, azo dye, or a metal complex of organic acid. Specific examples of the negative charge controlling agent include BONTRON (S-31, S-32, S-34, S-36, S-37, S-39, S-40, S-44, E-81, E-82, E-84, E-86, E-88, A, 1-A, 2-A, 3-A) (all manufactured by Orient Chemical Industries, Ltd.); KAYACHARGE (N-1, and N-2), KAYASET BLACK (T-2, 004) all manufactured by Nippon Kayaku Co., Ltd.); AIZEN SPIRON BLACK T-37, T-77, T-95, TRH, TNS-2) (all manufactured by Hodogaya Chemical Co); and FCA-1001-N, FCA-1001-NB, and FCS-1001-NZ (all manufactured by Fujikura Kasei Co., Ltd.).

For the positive charge controlling agent, it is possible to use, for example, basic compounds such as nigrosine dyes, cationic compounds such as tetra ammonium salts, metal salts such as higher fatty acids. Specific examples thereof include BONTRON (N-01, N-02, N-03, N-04, N-05, N-07, N-09, N-10, N-11, N-13, P-51, P-52, and AFT-B) (all manufactured by Orient Chemical Industries, Ltd.); TP-302, TP-415, and TP-4040 (all manufactured by Hodogaya Chemical Co.); COPY BLUE PR, COPY CHARGE (PX-VP-435, NX-VP-434) (all manufactured by Hochst Corporation); FCA (201, 201-B-1, 201-B-2, 201-B-3, 201-PB, 201-PZ, and 301) (all manufactured by Fujikura Kasei Co., Ltd.); and PLZ (1001, 2001, 6001, and 7001) (all manufactured by SHIKOKU CHEMICALS CORP.).

Each of these positive charge controlling agents may be used alone or in combination with two or more.

The additive amount of the charge controlling agent is determined depending on the type of a binder resin used and the toner production method including a dispersion method and cannot unequivocally defined, however, the additive amount of the charge controlling agent is preferably 0.1 parts by mass to 10 parts by mass and more preferably 0.2 parts by mass to 5 parts by mass to 100 parts by mass of the binder resin. When the additive amount of the charge controlling agent is more thane 10 parts by mass, the excessively high chargeability impairs an effect of the charge controlling agent, and an electrostatic suction force to a developing roller is increased, which may cause degradation in flowability of the developer and degradation in image density. When the additive amount of the charge controlling agent is less than 0.1 parts by mass, the charge rising property and the charge amount of the developer are not insufficient, which may affect toner images.

In the toner material, an inorganic fine particle, a flowability improving agent, a cleaning ability improving agent, a magnetic material, and a metal soap can be added besides a binder resin, a releasing agent, a colorant and a charge controlling agent.

For the inorganic fine particle, it is possible to use, for example, silica, titania, alumina, cerium oxide, strontium titanate, calcium carbonate, magnesium carbonate, and calcium phosphate. It is more preferable to use a silicone oil, a silica fine particle that has been subjected to a hydrophobizing treatment with hexamethyl disilazane or a titanium oxide that has been subjected to a specific surface treatment.

Examples of the silica fine particle include AEROSIL (130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200, and REA200) (all manufactured by Nippon AEROSIL CO. LTD.); HDK (H20, H2000, H3004, H2000/4, H2050EP, H2015EP, H3050EP, and KHD50), HVK2150 (all manufactured by WACKER-CHEMIE GMBH); CAB-O-SIL (L-90, LM-130, LM-150, M-5, PTG, MS-55, H-5, HS-5, EH-5, LM-150D, M-7D, MS-75D, TS-720, TS-610, and TS-530) (all manufactured by CABOT Corp.).

The additive amount of the inorganic fine particle is preferably 0.1 parts by mass to 5.0 parts by mass and more preferably 0.8 parts by mass to 3.2 parts by mass to 100 parts by mass of the toner base particle.

The method for producing a toner is not particularly limited and may be suitably selected in accordance with the intended use. Examples of the method for producing a toner include pulverization method; polymerization method (suspension polymerization method, emulsification polymerization method) in which a monomer composition containing a specific crystalline polymer and a polymerizable monomer is directly polymerized in an aqueous phase; polyaddition reaction method in which a composition containing a specific crystalline polymer and an isocyanate group-containing prepolymer is directly elongated or crosslinked with amines in an aqueous phase, polyaddition reaction method using an isocyanate group-containing prepolymer; pulverization method in which a toner material is dissolved with a solvent, the solvent is removed, and the toner material is pulverized; and fusion spraying method.

The pulverization method is a method of obtaining the toner base particle, for example, by fusing or kneading, pulverizing a toner material and then classifying the particle. In a case of the pulverization method, for the purpose of increasing the average circularity of the toner, the obtained toner base particle may be controlled by applying a mechanical impulse force. In this case, the mechanical impulse force can be applied to the toner base particle using equipment such as hybridizer and mechanofusion. Then, the above-noted toner materials are mixed and the mixture is placed in a fusion kneader to be fusion-kneaded. For the fusion-kneader, for example, a uniaxial or biaxial continuous kneader or a batch type kneader such as a roller mill can be used. For example, KTK type biaxial extruder manufactured by KOBE STEEL., LTD.; TEM type biaxial extruder manufactured by TOSHIBA MACHINE CO., LTD.; biaxial extruder manufactured by KCK Co., Ltd.; PCM type biaxial extruder manufactured by IKEGAI, LTD. and continuous type uniaxial extruder such as co-kneader manufactured by BUSS are preferably used. It is preferable that the fusion and kneading be carried out under such appropriate conditions so as not to cut molecular chains of the binder resin. Specifically, the fusion kneading temperature is set in reference to the softening point of the binder resin. When the fusion kneading temperature is excessively higher than the softening point, the molecular chains of the binder resin are severely cut off, and when excessively lower than the softening point, the dispersion of the toner material may not proceed.

In the pulverization, the kneaded product obtained in the kneading is pulverized. In the pulverization, it is preferred that first the kneaded product be coarsely crushed and then finely pulverized. It is also preferred that the toner material mixture be pulverized by making particles collide with a collision plate or making particles collide with each other in a jet stream or pulverizing the toner mixture particles in a narrow gap between a mechanically rotatable rotor and a stator.

In the classification of particles, the pulverized material obtained in the pulverization is classified to prepare particles having predetermined particle diameters. The classification can be carried out by removing fine particles using, for example, a cyclone, a decanter, a centrifugal separator or the like.

After completion of the pulverization and classification, the pulverized material is classified in a stream by applying a centrifugal force thereto, thereby producing a toner base particle having predetermined particle diameters.

In the suspension polymerization method, a colorant and a releasing agent etc. are dispersed in an oil-soluble polymerization initiator and a polymerizable monomer, and the components are emulsified and dispersed in an aqueous medium containing a surfactant and other solid dispersing agent, etc. by emulsification method, which will be explained below. Thereafter, the emulsified product is subjected to a polymerization reaction to be formed into particles, and then the particle product may be subjected to a wet process in which the inorganic fine particle is made to adhere on the surface of the toner particles of the present invention. At this point in time, it is preferable to perform necessary treatment to obtain toner particles on which an excessive amount of surfactant and the like is washed and removed.

For the polymerizable monomer, for example, a functional group can be introduced into the toner particle surface by partially using acids such as acrylic acid, methacrylic acid, α-cyanoacrylic acid, α-cyanomethacrylic acid, itaconic acid, crotonic acid, fumaric acid, maleic acid or maleic acid anhydride; acrylamide, methacrylamide, diacetone acrylamide or methylol compounds thereof; and (meth)acrylates having an amino group such as vinylpyridine, vinylpyrolidone, vinyl imidazole, ethylene imine, and dimethylaminoethyl methacrylate.

Further, by selecting a dispersing agent having an acid group or a basic group for use, the dispersing agent is made absorbed in the particle surface to remain thereon, thereby the functional group can be introduced thereinto.

In the emulsification polymerization method, a water-soluble polymerization initiator and a polymerizable monomer are emulsified in water using a surfactant, and a latex is synthesized by a commonly used emulsification polymerization technique. Separately, a dispersion liquid in which a colorant, a releasing agent and the like are dispersed in an aqueous medium is prepared, the latex and the dispersion liquid are mixed, then the mixture is made agglomerate until droplets of the toner size are formed, and the mixture is heated and fused to thereby obtain a toner. Thereafter, the wet process of an inorganic fine particle, which will be explained below, is provided to the toner. By using a monomer similarly to that used in the suspension polymerization method as a latex, a functional group can be introduced in the toner particle surface.

Of these toners produced by any one of the toner production methods, a toner that can be obtained by the following process is preferable because the toner allows for selectability of a wide variety of resins, has high low-temperature fixing ability, is excellent in granulation property, and also allows for easy control of particle diameter, particle size distribution, and shape. Specifically, a toner material containing an active hydrogen group-containing compound and a polymer capable of reacting with the active hydrogen group-containing compound is dissolved or dispersed in an organic solvent to prepare a toner solution, then the toner solution is emulsified or dispersed in an aqueous medium to prepare a dispersion liquid to react the active hydrogen group-containing compound and the with the polymer capable of reacting with the active hydrogen group-containing compound in the aqueous medium to obtain an adhesive base, the adhesive base is formed into particles, the organic solvent is removed thereby produce a toner.

The toner material contains at least an adhesive base that can be obtained by reacting an active hydrogen group-containing compound, a polymer capable of reacting with the active hydrogen group-containing compound, a binder resin, a charge controlling agent and a colorant, and further contains other components such as a resin fine particle and a releasing agent in accordance with the intended use.

Further, to improve the flowability, developing property, transferring property of the toner, an organic fine particle such as hydrophobic silica fine powder may be added and mixed in the toner base particle produced as described above. For mixing additives, a mixer generally used for powder is used, however, the mixer is preferably equipped with a jacket or the like such that the inside temperature can be adjusted. To change history of load applied to additives, the additives can be added in the mixer in the middle of the mixing or gradually. In this case, the rpm, rolling rate, time, temperature etc. of the mixer may be changed. In the mixing, first a strong load may be applied to the toner material and then a relatively weak load may be applied, or the load application order may be reversed. For usable mixing equipment, for example, V-type mixer, rocking mixer, LOEDIGE mixer, NAUTA mixer, and HENSCHEL mixer. Next, the mixture is filtered through a screen with a mesh of 250 or more to remove coarse particles and flocculate particle to thereby obtain a toner.

The toner is not particularly limited as to the shape and size, and may be suitably selected in accordance with the intended use, however, the toner preferably has the following average circularity, volume average particle diameter, ratio of volume average particle diameter to number average particle diameter (volume average particle diameter/number average particle diameter).

The average circularity is a value that the circumferential length of a circle that has an equivalent shape and an equivalent projected area to those of the toner is divided by the circumferential length of an actual particle. For example, the average circularity is preferably 0.900 to 0.980 and more preferably 0.950 to 0.975. Note that, a toner containing particles that have an average circularity less than 0.94 at 15% or less is preferable.

When the average circularity is less than 0.900, a high-quality image having satisfiable transferring property and causing no dust may not be obtained, and when more than 0.980, in an image forming system using bread cleaning technique, cleaning defects occur on the photoconductor and the transfer belt in the system, image smear, for example, in a case of formation of an image having a high-image area ratio such as photographic image, a toner forming an untransferred image due to a paper-feeding defect or the like accumulates on the photoconductor remains an untransferred toner thereon, and the untransferred toner may cause background smear on images, or a charging roller etc. that contact-charges the photoconductor is contaminated with the untransferred toner, thereby the toner may not exert its intrinsic chargeability.

In the present invention, the average circularity was measured using a flow particle image analyzer ("FPIA-2100", manufactured by SYSMEX Corp.) and then analyzed using analysis software (FPIA-2100 Data Processing Program for FPIA version 00-10). Specifically, the average circularity was measured as follows. In a 100 mL glass beaker, 0.1 mL to 0.5 mL of 10% by mass of a surfactant (alkylbenzene sulfonate, NEOGEN SC-A, manufactured by Dai-ichi Kogyo Seiyaku Co., Ltd.) was added, 0.1 g to 0.5 g of each toner was added thereto, and the toner is mixed with the surfactant using a micro-spatula. Next, 80 mL of ion exchange water was added thereto. The obtained dispersion liquid was subjected to a dispersion treatment in an ultrasonic dispersing device (manufactured by HONDA ELECTRONICS CO., LTD.) for three minutes. The toner shape and the particle distribution of the dispersion liquid were measured using the FPIA-2100 until a concentration of 5,000 μL to 15,000/μL could be obtained. In this measurement, from the perspective of measurement reproductivity of the average circularity, it is important that the concentration of the dispersion liquid is adjusted to 5,000 μL to 15,000 μL. To obtain the concentration of the dispersion liquid, it is necessary to change conditions of the dispersion liquid, i.e., the amount of the surfactant to be added and the toner amount. The necessary amount of the surfactant differs depending on the hydrophobization of the toner, just as in the measurement of the toner particle diameter described above. When an excessively large amount of the surfactant is added, noise occurs due to bubble, and when an excessively small amount of the surfactant is added, it is impossible to get the toner sufficiently wet, and thus the dispersion is insufficient. Further, the additive amount of the toner differs depending on the toner particle diameter. When the toner has a small diameter, it is necessary to reduce the additive amount, and when the toner has a large diameter, it is necessary to increase the additive amount. When the toner particle diameter is 3 μm to 10 μm, the concentration of the dispersion liquid can be adjusted to 5,000 μL to 15,000 μL by adding 0.1 g to 0.5 g of the toner.

The volume average particle diameter of the toner is not particularly limited and may be suitably adjusted in accordance with the intended use. For example, it is preferably 3 μm to 10 μm and more preferably 3 μm to 8 μm.

When the volume average particle diameter is less than 3 μm, in a two-component developer, the toner fused and adhered on the surface of a carrier in a long time agitation in a developing device, which may degrade the chargeability of the carrier, and when it is more than 10 μm, it is difficult to obtain a high-quality image with high-resolution, and when the toner inflow/outflow is performed in the developer, the toner particle diameter may fluctuate largely.

The ratio of a volume average particle diameter to a number average particle diameter of the toner (volume average particle diameter/number average particle diameter) is preferably 1.00 to 1.25 and more preferably 1.10 to 1.25.

The volume average particle diameter and the ratio of the volume average particle diameter to the number average particle diameter (volume average particle diameter/number average particle diameter) were measured by using a particle size measurement device ("MULTISIZER III" manufactured by Beckman Coulter Co.) with an aperture diameter of 100 μm and then analyzed by using analysis software (Beckman Coulter MULTISIZER 3 VERSION 3.51). Specifically, in a 100 mL glass beaker, 0.5 mL of 10% by mass of a surfactant (alkylbenzene sulfonate, NEOGEN SC-A, manufactured by Dai-ichi Kogyo Seiyaku Co., Ltd.) was added, 0.5 g of each toner was added thereto, and the toner is mixed with the surfactant using a micro-spatula. Next, 80 mL of ion exchange water was added thereto. The obtained dispersion liquid was subjected to a dispersion treatment in an ultrasonic dispersing device (W-113MK-II, manufactured by HONDA ELECTRONICS CO., LTD.) for ten minutes. The volume average particle diameter and the ratio of the volume average particle diameter to the number average particle diameter (volume average particle diameter/number average particle diameter) were measured using the MULTISIZER III with the use of ISOTON III as a solution for measurement. The toner sample dispersion liquid was delivered by drops in the device such that the concentration indicated by the device was 8%±2%. In this measurement, from the perspective of measurement reproductivity of particle diameter, it is important that the concentration of the toner sample dispersion liquid is adjusted to 8%±2%. Within the concentration range, no error occurs.

The colorant of the toner is not particularly limited and may be suitably selected in accordance with the intended use, and it is possible to use at least one selected from black toners, cyan toners, magenta toners and yellow toners. Each of color toners can be obtained by suitably selecting the type of the colorants, however, color toners are preferable.

<Developer Container>

The developer container according to the present invention houses the developer of the present invention.

The container is not particularly limited and may be suitably selected from among conventional developer containers. For example, a developer container having a developer container main body and a cap is preferably exemplified.

The developer container is not particularly limited as to the size, shape, structure, material and the like and may be suitably selected in accordance with the intended use. For example, as to the shape, a cylindrical shape is preferable. As to the structure, a container is particularly preferable in which a continuous spiral convexoconcave is formed on the inner surface, a developer contained in the container can be moved toward the outlet by rotating the developer container and a part of the spiral portion or the whole thereof has an accordion function.

Material of the developer container main body is not particularly limited. A material that is formable with excellent dimensional precision is preferable. Preferred examples thereof include resins. Among resins, for example, polyester resins, polyethylene resins, polypropylene resins, polystyrene resins, polyvinyl chloride resins, polyacrylic resins, polycarbonate resins, ABS resins, polyacetal resins and the like are preferably exemplified.

The developer container allows for easy storage and easy transportation, is excellent in handleability, detachably mounted to the process cartridge and the image forming apparatus of the present invention and can be preferably used for supply the developer.

<Process Cartridge>

The process cartridge of the present invention has at least a latent electrostatic image bearing member that carries a latent electrostatic image thereon, and a developing unit configured to develop the latent electrostatic image carried on the latent electrostatic image bearing member using a developer to form a visible image and further has other units suitably selected in accordance with necessity.

The developing unit has at least a developer container to house the developer of the present invention, and a developer carrier that bears the developer housed in the developer container and carries the developer carrier and may further have a layer thickness controlling member to control the layer thickness of a toner, in accordance with necessity.

The process cartridge can be detachably mounted to various electrophotographic image forming apparatuses, and it is preferable that the process cartridge be detachably mounted to the image forming apparatus of the present invention.

Figure 2:
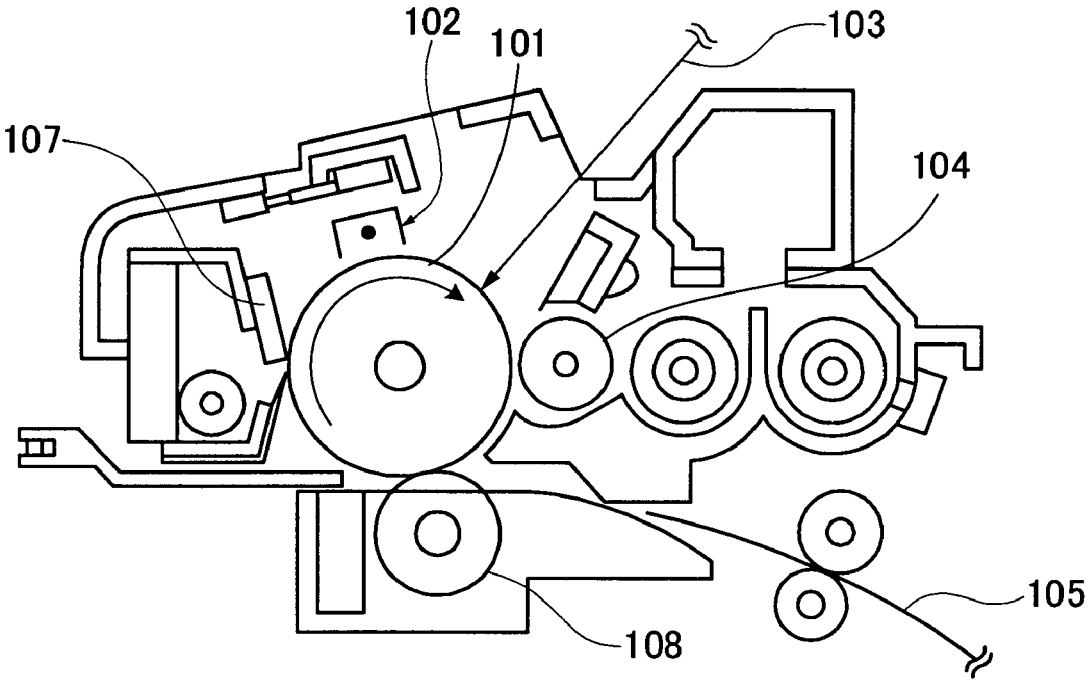
FIG. 2 is a schematic block diagram showing one example of a process cartridge.

The process cartridge incorporates, as shown in FIG. 2, a photoconductor 101, a charging unit 102, a developing unit 104, a transfer unit 108 and a cleaning unit 107 and further has other units in accordance with necessity. In FIG. 2, a reference numeral 103 denotes exposure using an exposing unit, in which a light source allowing for writing at high-resolution is used, and a reference numeral 105 denotes a recording medium. For the photoconductor 101, an image forming apparatus similarly to that to be explained hereinafter can be used. For the charging unit 102, an arbitrarily selected charging member is used.

Next, in an image forming process using the process cartridge shown in FIG. 2, the photoconductor 101 goes through charging by the charging unit 102 and goes through exposure 103 by the exposing unit (not shown) while rotating in the direction indicated by the curved arrow, and a latent electrostatic image corresponding to an exposed image is formed of the surface of the photoconductor 101. The latent electrostatic image is developed by the developing unit 104 using a toner to form a toner image, and the obtained toner image is transferred onto the recording medium 105 by the transfer unit 108 to be printed out. Subsequently, the surface of the photoconductor that has gone through the image transfer is cleaned by the cleaning unit 107, and further, a residual charge remaining thereon is eliminated by a charge eliminating unit. The operations stated above are repeated again.

(Image Forming Method and Image Forming Apparatus)

The image forming method of the present invention includes at least a latent electrostatic image forming step, a developing step, a transferring step and a fixing step, and further includes suitably selected other steps in accordance with necessity, for example, a charge eliminating step, a cleaning step, a recycling step and a controlling step.

The image forming apparatus used in the present invention has at least a latent electrostatic image bearing member, a latent electrostatic image forming unit, a developing unit, a transfer unit and a fixing unit, and further has suitably selected other units in accordance with necessity, for example, a charge eliminating unit, a cleaning unit, a recycling unit and a controlling unit.

The latent electrostatic image forming step is a step in which a latent electrostatic image is formed on the a latent electrostatic image bearing member.

The latent electrostatic image bearing member (may be referred to as "electrophotographic photoconductor" or "photoconductor") is not particularly limited as to the material, shape, structure, size and the like, and may be suitably selected in accordance with the intended use. For the shape of the latent electrostatic image bearing member, for example, drum shape is preferably exemplified. Preferred examples of the material used for the latent electrostatic image bearing member include inorganic photoconductors composed of amorphous silicon, selenium or the like; organic photoconductors (OPCs) composed of polysilane, phthalopolymethine or the like.

The formation of a latent electrostatic image can be carried out, for example, by uniformly charging the surface of the latent electrostatic image bearing member and then imagewisely exposing the surface of the latent electrostatic image bearing by means of the latent electrostatic image forming unit. The latent electrostatic image forming unit is equipped with at least a charger that uniformly charges the surface of the latent electrostatic image bearing member, and an exposer that imagewisely exposes the surface of the latent electrostatic image bearing member.

The surface of the latent electrostatic image bearing member can be charged by applying a voltage to the surface of the latent electrostatic image bearing using the charger by means of the charger.

The charger is not particularly limited and may be suitably selected in accordance with the intended use. Examples thereof include known contact chargers each of which is equipped with a conductive or semi-conductive roller, brush, film, rubber blade, or the like, and non-contact charger utilizing a corona discharge such as corotron and scorotoron.

The charger is preferably a charger that can be placed in contact or noncontact with a latent electrostatic image bearing member and is configured to charge the surface of the latent electrostatic image bearing member by superimposingly applying a direct current and an alternating voltage.

Further, the charger is preferably a charge roller that can be closely placed in noncontact with a latent electrostatic image bearing member via a gap tape and is configured to charge the surface of a latent electrostatic image bearing member by superimposingly applying a direct current and an alternating voltage to the charge roller.

The exposure can be carried out, for example, by imagewisely exposing the surface of the latent electrostatic image bearing member by means of the exposer.

The exposer is not particularly limited and may be suitably selected in accordance with the intended use, as long as it can imagewisely expose the surface of the latent electrostatic image bearing member that has been charged by the charger, in a manner where an image to be formed can be exposed. Examples of the exposing unit include various exposers such as reproducing optical systems, rod lens array systems, laser optical systems, and liquid crystal shutter optical systems.

In the present invention, the back light method may be employed in which exposure is performed imagewisely from the back side of the photoconductor.

—Developing Step and Developing Unit—

The developing step is a step in which the latent electrostatic image is developed using the developer of the present invention to form a visible image.

The formation of the visible image can be carried out by developing the latent electrostatic image using the developer of the present invention by means of the developing unit.

The developing unit is not particularly limited as long as it can develop a latent electrostatic image using the developer of the present invention, and may be suitably selected from those known in the art. For example, the developing unit is preferably a developing unit that has at least a developing device capable of supplying the developer to the latent electrostatic image in a contact or noncontact manner, and is more preferably a developing device equipped with the above-mentioned developer container.

The developing device may employ a dry-developing process or a wet-developing process. It may be a monochrome color image developing device or a multi-color image developing device. Preferred examples thereof include a developing device having a stirrer by which the toner or the developer is frictionally stirred to be charged, and a rotatable magnet roller.

In the developing device, for example, the toner and a carrier are mixed and stirred, the toner is charged by a frictional force at that time to be held in a state where the toner is standing on the surface of the rotating magnet roller to thereby form a magnetic brush. Because the magnet roller is located near the latent electrostatic image bearing member (photoconductor), a part of the toner constituting the magnetic brush formed on the surface of the magnet roller moves to the surface of the latent electrostatic image bearing member (photoconductor) by an electric attraction force. As the result, the latent electrostatic image is developed using the toner to form a visible toner image on the surface of the latent electrostatic image bearing member (photoconductor).

A developer to be housed in the developing device is the developer of the present invention.

—Transferring Step and Transfer Unit—

The transferring step is a step in which the visible image is transferred onto a recording medium. For the transferring step, an aspect is preferable, in which an intermediate transfer member is used, a visible image is primarily transferred to the intermediate transfer member, and then the visible image is secondarily transferred onto the recording medium. An aspect is more preferable, in which for the toner, two or more colors of toner, preferably full-color toners are used, and a primary transferring step and a secondary transferring step are included. In the primary transferring step, a visible image is transferred to an intermediate transfer member to form a composite image, and in the secondary transferring step, the composite image is transferred onto a recording medium.

The transferring can be carried out by charging the visible image formed on the latent electrostatic image bearing member (photoconductor) using a transfer charger, i.e., by means of the transfer unit. For the transfer unit, an aspect is preferable which has a primary transfer unit configured to transfer a visible image to an intermediate transfer member to form a composite image, and a secondary transfer unit configured to transfer the composite image onto a recording medium.

The intermediate transfer member is not particularly limited and may be suitably selected from among conventional transfer members in accordance with the intended use. For example, a transfer belt is preferably exemplified.

The transfer unit (the primary transfer unit, and the secondary transfer unit) preferably has at least an image transferer that exfoliates and charges the visible image formed on the latent electrostatic image bearing member (photoconductor) to be transferred onto the recording medium. For the transfer unit, one unit may be used or two or more units may be used.

Specific examples of the image transferer include corona-charge transferers, transfer belts, transfer rollers, pressure-transfer rollers and adhesion transferers.

The recording medium is not particularly limited and may be suitably selected from among conventional recording media (recording paper).

The fixing step is a step in which the transferred visual image is fixed on a recording medium using a fixing device. The fixing may be performed every time each of color developers is transferred onto the recording medium or may be performed at a time in a condition where individual color developers are superimposed.

The fixing device is not particularly limited and may be suitably selected in accordance with the intended use, however, a conventional heating-pressurizing unit is preferably used. For the heating-pressurizing unit, a combination of a heating roller and a pressurizing roller, and a combination of a heating roller and a pressurizing roller are exemplified.

The fixing device is preferably a fixing device that has a heater equipped with a heat generator, a film making contact with the heater, and a pressurizing member pressure-contacting the heater via the film and is configured to thermally fix a transferred image on a recording medium by passing an unfixed image formed in between the film and the pressurizing member. The heating temperature of the heating-pressurizing unit is preferably 80° C. to 200° C.

In the present invention, for example, a conventional optical fixing device may be used in accordance with the intended use, or along with the fixing unit in the fixing step or instead of the fixing unit.

The charge eliminating step is a step in which a charge elimination bias is applied to the latent electrostatic image bearing member to remove a charge, and the charging is preferably carrier out by a charge eliminating unit.

The charge eliminating unit is not particularly limited, as long as it can apply a charge elimination bias to the latent electrostatic image bearing member, and may be suitably selected from among conventional charge eliminating devices. Preferred examples thereof include charge eliminating lamps.

The cleaning step is a step in which a residual toner remaining on the latent electrostatic image bearing member is removed, and the cleaning can be suitably carried out by means of a cleaning unit.

The cleaning unit is not particularly limited as long as a residual electrophotographic toner remaining on the electrophotographic photoconductor can be removed by means of the cleaning unit. The cleaner may be suitably selected from among those known in the art. Preferred examples thereof include magnetic brush cleaners, electrostatic brush cleaners, magnetic roller cleaners, blade cleaners, brush cleaners and web cleaners.

The recycling step is a step in which the toner removed in the cleaning step is recycled to the developing unit, and the recycling is preferably carried out by a recycling unit. The recycling unit is not particularly limited, and examples thereof include conventional conveying units.

The controlling step is a step in which the above-noted respective steps are controlled, and the controlling can be preferably carried out by a controlling unit.

The controlling unit is not particularly limited as long as it can control operations of the above-noted respective units, and may be suitably selected in accordance with the intended use. Examples thereof include equipment such as sequencers and computers.

Hereinafter, an aspect in which the image forming method of the present invention is carried out by the above-mentioned image forming apparatus will be explained with reference to FIG. 3. An image forming apparatus 100 shown in FIG. 3 is provided with a photoconductor drum 10 (a latent electrostatic image bearing member 10) as the latent electrostatic image bearing member, a charging roller 20 as the charging unit, an exposing device 30 as the exposing unit, a developing device 40 as the developing unit, an intermediate transfer member 50, a cleaning device 60 using a cleaning blade, as the cleaning unit, and a charge eliminating lamp 70 as the charge eliminating unit.

The intermediate transfer member 50 is an endless belt and is designed to be movable in the direction indicated by the arrow by tree rollers 51 that are located inside of the intermediate transfer member 50 and respectively span the intermediate transfer member 50. A part of the tree rollers 51 functions as a transfer bias roller that can apply a predetermined transfer bias (primary transfer bias) to the intermediate transfer member 50. Near the intermediate transfer member 50, an intermediate transfer member cleaning blade 90 is located, and a transfer roller 80 serves as the transfer unit which can apply a transfer bias for secondarily transferring a visual image (toner image) onto a recording medium 95 is placed to face the intermediate transfer member 50. Around the intermediate transfer member 50, a corona charger 58 for applying a charge to the visual image on the intermediate transfer member 50 is located in between a contact position between the latent electrostatic image bearing member 10 and the intermediate transfer member 50 and a contact position between the intermediate transfer member 50 and the recording medium 95.

The developing device 40 is composed of a developing belt 41 as a developer carrier, and a black developing unit 45K, a yellow developing unit 45Y, a magenta developing unit 45M and a cyan developing unit 45C which are arranged around the developing belt 41. The black developing unit 45K is equipped with a developer container 42K, a developer supplying roller 43K and a developing roller 44K. The yellow developing unit 45Y is provided with a developer container 42Y, a developer supplying roller 43Y and a developing roller 44Y. The magenta developing unit 45M is equipped with a developer container 42M, a developer supplying roller 43M and a developing roller 44M. The cyan developing unit 45C is equipped with a developer container 42C, a developer supplying roller 43C and a developing roller 44C. The developing belt 41 is an endless belt and is rotatably spanned over a plurality of belt rollers, and a part thereof makes contact with the latent electrostatic image bearing member 10.

Figure 3:
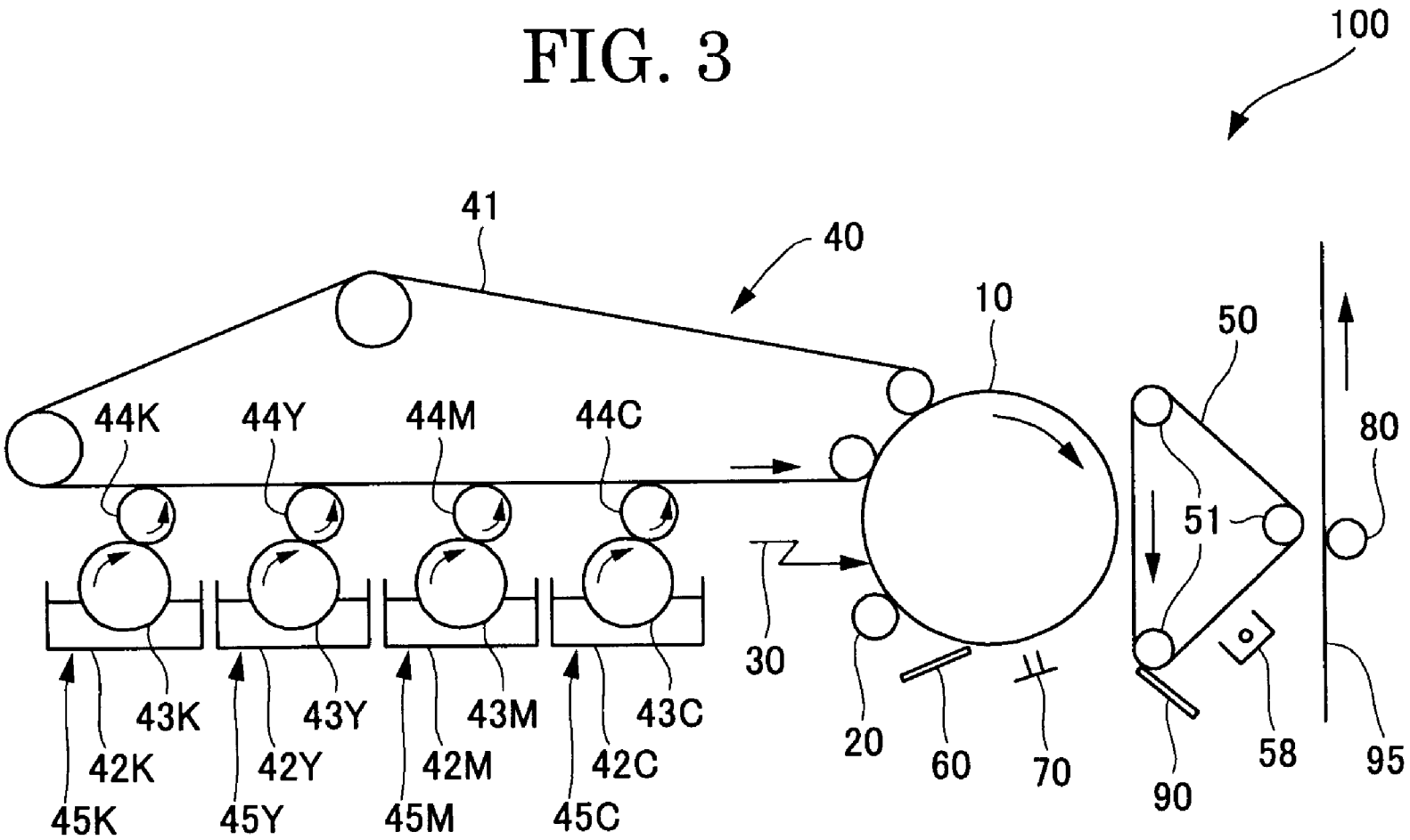
FIG. 3 is a schematic illustration showing one example of carrying out the image forming method of the present invention by using an image forming apparatus.

In the image forming apparatus 100 shown in FIG. 3, for example, the charging roller 20 uniformly charges the photoconductor drum 10, the exposing device 30 imagewisely exposes the surface of the photoconductor drum 10 to form a latent electrostatic image. The latent electrostatic image formed on the photoconductor drum 10 is developed by supplying a toner from the developing device 40 thereto to form a visible image (a toner image). The visible image (the toner image) is primarily transferred onto the intermediate transfer member 50 by a voltage applied from the rollers 51 (primary transfer) and further transferred onto the recording medium 95 (secondary transfer). As a result, a transfer image is formed on the recording medium 95. A residual toner remaining on the surface of the photoconductor drum 10 is removed by the cleaning blade 60, and a charge remaining on the photoconductor drum 10 is once removed by the charge eliminating lamp 70.

Figure 4:
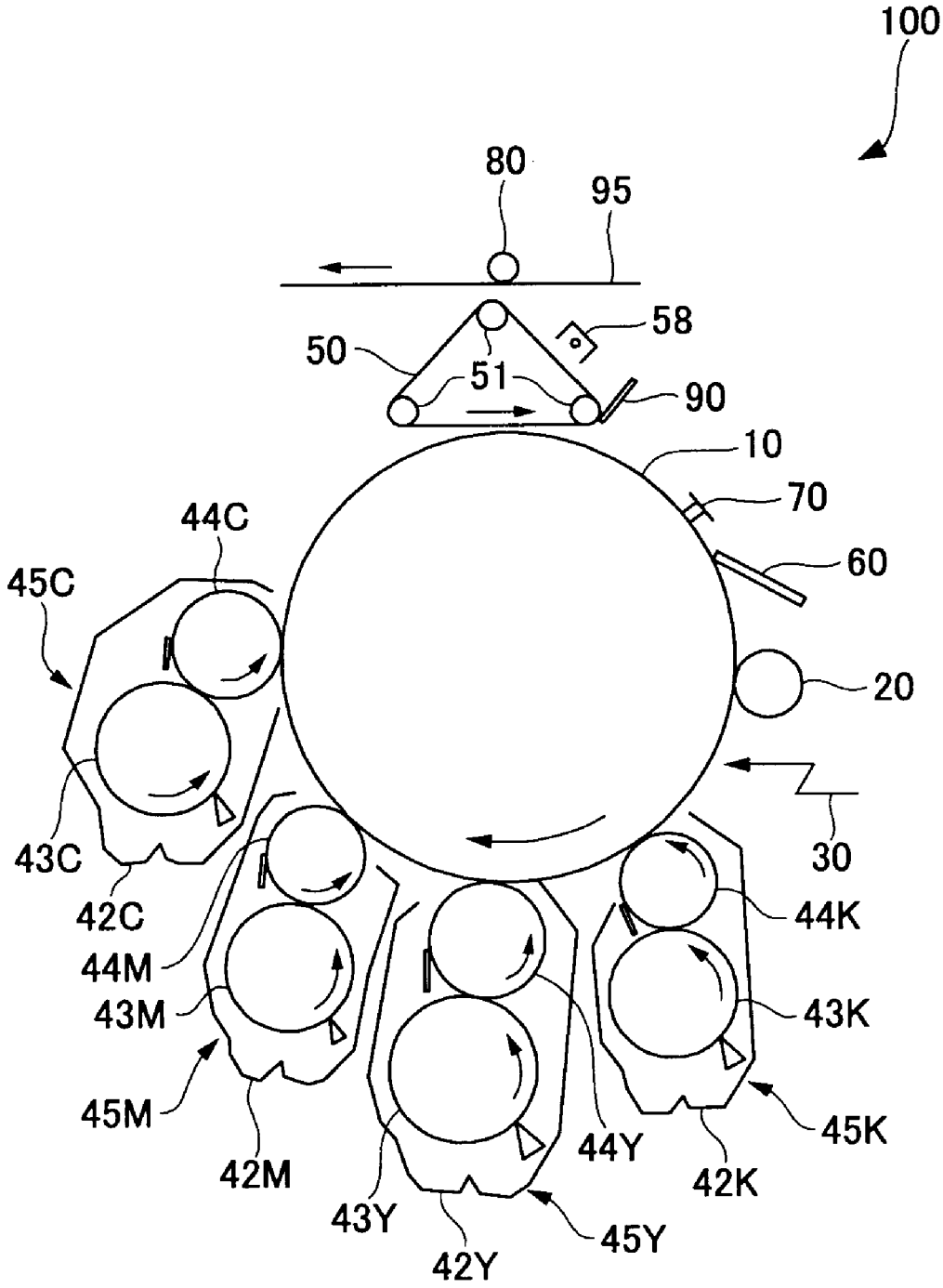
FIG. 4 is a schematic illustration showing another example of carrying out the image forming method of the present invention by using an image forming apparatus.

Next, another aspect in which the image forming method of the present invention is carried out by the image forming apparatus will be explained with reference to FIG. 4. An image forming apparatus 100 shown in FIG. 4 is not equipped with the developing belt 41 serving as a developer carrier as in the image forming apparatus 100 shown in FIG. 3 and has the same structure and the same operational effects as those of the image forming apparatus 100 shown in FIG. 3, except that a black developing unit 45K, a yellow developing unit 45Y, a magenta developing unit 45M and a cyan developing unit 45C are directly arranged around a photoconductor 10 so as to face the photoconductor 10. The same components as shown in FIG. 4 are denoted at the same numerals as shown in FIG. 3.

Figure 5:
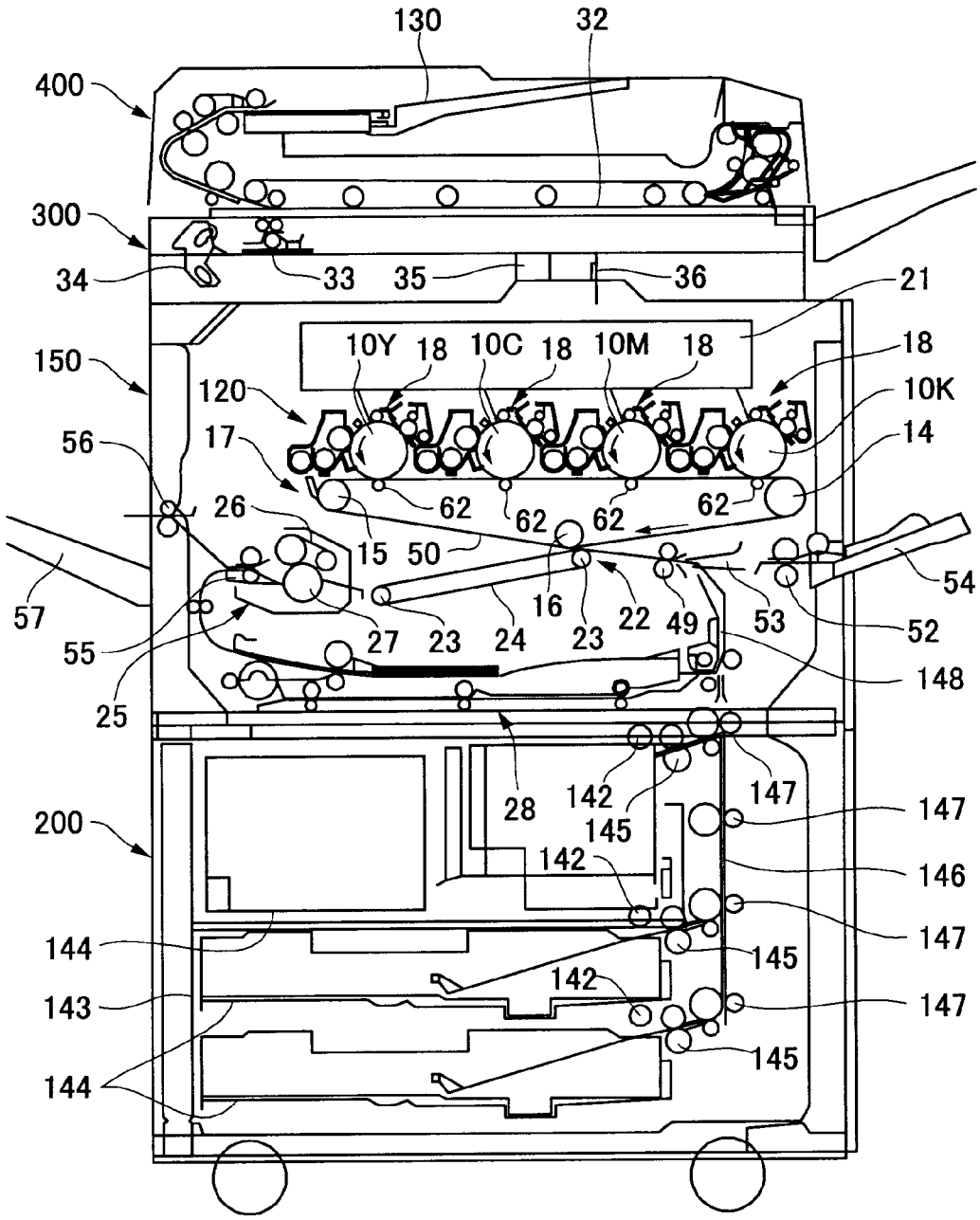
FIG. 5 is a schematic illustration showing one example of carrying out the image forming method of the present invention by using an image forming apparatus (tandem-color image forming apparatus).

A still another aspect in which the image forming method of the present invention is carried out by using the image forming apparatus will be explained with reference to FIG. 5. The tandem type image forming apparatus shown in FIG. 5 is a tandem type color image forming apparatus. The tandem type color image forming apparatus is equipped with a copier main body 150, a sheet feeder table 200, a scanner 300 and an automatic document feeder 400.

The copier main body 150 includes an endless belt intermediate transfer member 50 at its center part. The intermediate transfer member 50 is spanned over three support rollers 14, 15, and 16 and is capable of rotating and moving in a clockwise direction in FIG. 5. An intermediate-transfer-member cleaning unit 17 is capable of removing a residual toner from the intermediate transfer member 50 after image transfer and is placed near the support roller 15. Above the intermediate transfer member 50 spanned between the support rollers of 14 and 15, a tandem type developing unit 120 is placed so that yellow, cyan, magenta, and black image forming units (image forming sections) 18, namely four image forming units (four image forming sections), are arrayed in parallel to face the intermediate transfer member 50 in the moving direction of the intermediate transfer member 50. An exposer 21 is arranged in the vicinity of the tandem type developing unit 120. A secondary transfer unit 22 faces the tandem type developing unit 120 with the interposition of the intermediate transfer member 50. The secondary transfer unit 22 is equipped with an endless belt serving as secondary transferring belt 24 which is spanned over a pair of rollers 23. A recording medium being transported on the secondary transferring belt 24 can make contact with the intermediate transfer member 50. A fixing device 25 is equipped with a fixing belt 26 that is an endless belt, and a pressurizing roller 27 that is placed so as to be pressed by the fixing belt 26.

In the tandem type image forming apparatus, a sheet reverser 28 is located in the vicinity of the secondary transfer unit 22 and the fixing device 25. The sheet reverser 28 is capable of reversing the recording medium so as to form images on both sides of the recording medium.

Hereinafter, the way of forming a full-color image, i.e. the way a color copy is formed by using the tandem type developing unit 120 will be described. Initially, a document is placed on a document platen 130 of the automatic document feeder (ADF) 400. Alternatively, the automatic document feeder (ADF) 400 is opened, a document is placed on a contact glass 32 of the scanner 300, and the automatic document feeder (ADF) 400 is closed to press the document.

When pushing a start switch (not shown), the document placed on the automatic document feeder 400 is transported onto the contact glass 32. When the document is initially place on the contact glass 32, the scanner 300 is immediately driven to operate a first carriage 33 and a second carriage 34. Light is applied from a light source to the document by action of the first carriage 33, and reflected secondary light from the document is further reflected toward the second carriage 34. The reflected light is further reflected by a mirror of the second carriage 34 and passes through an image-forming lens 35 into a read sensor 36 to thereby read the color document, i.e. color image and to produce black, yellow, magenta and cyan image information.

Figure 6:
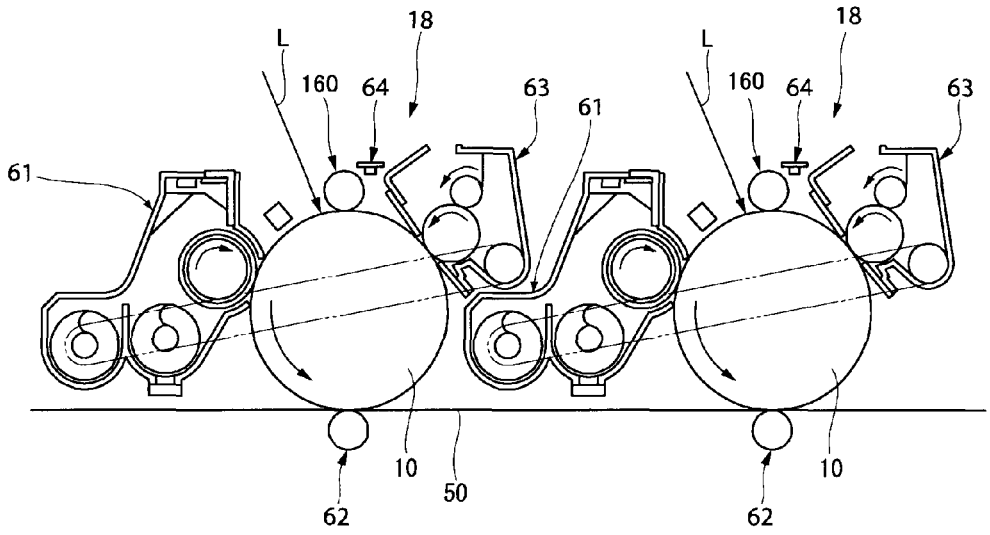
FIG. 6 is a partially enlarged schematic illustration of the image forming apparatus shown in FIG. 5.

Each of the black, yellow, magenta, and cyan image information is transmitted to each of the image forming units 18, i.e. black, yellow, magenta, and cyan image forming units in the tandem type developing unit 120 to thereby form individual toner images in black, yellow, magenta and cyan toner. Specifically, each of the image forming units 18 (black image forming unit, yellow image forming unit, magenta image forming unit and cyan image forming unit) in the tandem type developing unit 120 is equipped with, as shown in FIG. 6, latent electrostatic image bearing members 10 (black latent electrostatic image bearing member 10K, yellow latent electrostatic image bearing member 10Y, magenta latent electrostatic image bearing member 10M and cyan latent electrostatic image bearing member 10C); a charger 160 configured to uniformly charge the latent electrostatic image bearing member 10; an exposer configured to expose the latent electrostatic image bearing member 10 imagewisely corresponding to each color image based on each color image information, which is represented by L in FIG. 6, to form a latent electrostatic image corresponding to each color images on the latent electrostatic image bearing member; a developing device 61 configured to develop the latent electrostatic image using each color toner, i.e. black toner, yellow toner, magenta toner, and cyan toner to form a toner image which contains each of these color toners; a transfer charger 62 for transferring the toner image onto the intermediate transfer member 50; a cleaning device 63 and a charge-eliminator 64 to thereby respectively form a monochrome image, i.e. a black image, a yellow image, a magenta image and a cyan image based on the respective color image information. The thus formed black image, yellow image, magenta image and cyan image, i.e. the black image formed on the black latent electrostatic image bearing member 10K, the yellow image formed on the yellow latent electrostatic image bearing member 10Y, the magenta image formed on the magenta latent electrostatic image bearing member 10M, and the cyan image formed on the cyan latent electrostatic image bearing member 10C are sequentially transferred (primary transfer) onto the intermediate transfer member 50 which is rotated and shifted by the support rollers 14, 15, and 16. Then, the black image, the yellow image, the magenta image and the cyan image are superimposed on the intermediate transfer member 50 to thereby form a composite color image, i.e. a transferred color image.

In the meanwhile, one of feeder rollers 142 in the feeder table 200 is selectively rotated, sheets or recording media are ejected from one of multiple feeder cassettes 144 in a paper bank 143 and are separated by a separation roller 145 one by one into a feeder path 146, and are transported by transport roller 147 into feeder path 148 in the copier main body 150 and are bumped against a resist roller 49 and stopped. Alternatively, a feeder roller 142 is rotated to eject sheets or recording media on a manual bypass tray 54, the sheets are separated one by one by the separation roller 145 into a manual bypass feeder path 53 and are bumped against the resist roller 49 and stopped. The resist roller 49 is generally grounded, however, may be used under the application of a bias to remove paper dust of sheets. The resist roller 49 is rotated in synchronization with the movement of the composite color image, i.e. transferred color image on the intermediate transfer member 50 to transport the recording medium into between the intermediate transfer member 50 and the secondary transfer unit 22, and the composite color image, i.e. transferred color image is transferred onto the recording medium by action of the secondary transfer unit 22 (secondary transfer) to thereby transfer the color image to the recording medium. Separately, the intermediate transfer member cleaning device 17 removes a residual toner remaining on the intermediate transfer member 50 after image transfer.

The recording medium bearing the transferred color image is transported by the secondary transfer unit 22 into the fixing device 25, is applied with heat and pressure in the fixing device 25 to fix the composite color image, i.e. transferred color image on the recording medium. The recording medium then changes its direction by action of a switch blade 55 and ejected by an ejecting roller 56 to be stacked on an output tray 57. Alternatively, the recording medium changes its direction by action of the switch blade 55 into the sheet reverser 28, turns therein, is transported again to the transfer position, followed by image formation on the backside of the sheet. The recording medium bearing images on both sides thereof is ejected through the ejecting roller 56 and then stacked onto the output tray 57.

In the image forming apparatus and the image forming method of the present invention, the developer that has a high-mechanical strength and is capable of forming images at a high-image density without substantially causing toner scattering and background smear is used, and thus high-quality images can be efficiently formed.

The present invention can solve various conventional problems and can provide a latent electrostatic image developing carrier that has a core material and a coating layer on the core material, wherein the coating layer has a uniform thickness and a high-adhesion property between the core material and the coating layer, and also provide a method for producing the carrier, a developer using the carrier, which is capable of forming a high-quality image at a high-image density without substantially causing toner scattering and background smear, and an image forming method using the developer.

EXAMPLES

Hereinafter, the present invention will be further described in detail referring to specific Examples, however, the present invention is not limited to the disclosed Examples.

Production Example 1

Preparation of Toner 1

One hundred parts by mass of a polyester resin (mass average molecular mass=12,000), 2 parts by mass of a copper phthalocyanine pigment, and 2 parts by mass of a charge controlling agent represented by the following Structural Formula (A) (iodine salt of nonylene perfluoroether-p-trimethylaminopropyl phenylamide) were kneaded using a heat roller at 120° C., and the kneaded product was cooled down and solidified, and then pulverized and classified to thereby obtain a toner base particle having a volume average particle diameter of 7.1 μm, a number average particle diameter of 5.8 μm and an average circularity of 0.953.

Structural Formula (A)

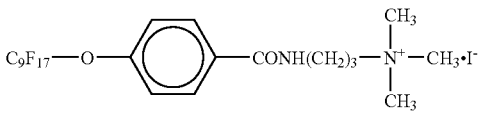

Next, to the obtained toner base particle, 0.5 parts by mass of silica (R972, manufactured by Nippon AEROSIL CO., LTD.) was added to 100 parts by mass of the toner base particle, and the toner base particle and the silica were mixed to prepare "Toner 1".

Production Example 2

Preparation of Toner 2

One hundred parts by mass of a polyester (mass average molecular mass=12,000), 5 parts by mass of a carbon black and 2 parts by mass of a chrome-containing azo dye represented by the following Structural Formula (B) were kneaded using a heat roller at 120° C., and the kneaded product was cooled down and solidified, and then pulverized and classified to thereby obtain a toner base particle having a volume average particle diameter of 7.3 μm, a number average particle diameter of 6.0 μm and an average circularity of 0.955.

Structural Formula (B)

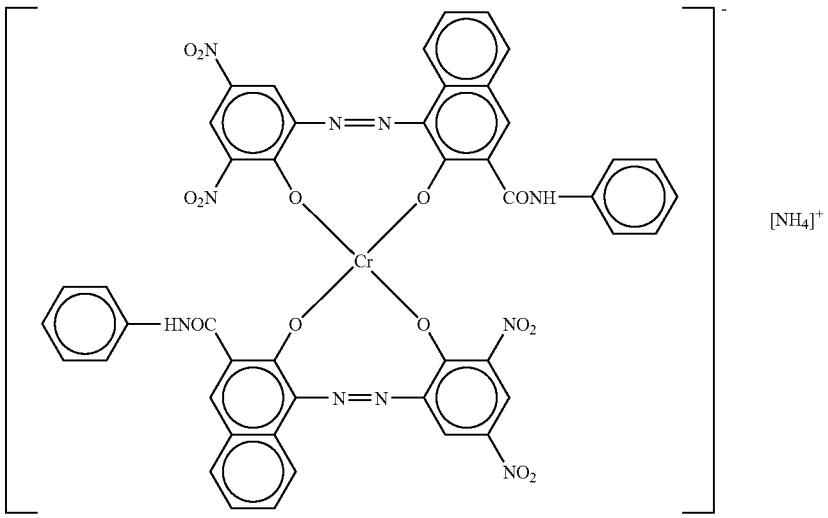

Next, 0.5 parts by mass of silica (R972, manufactured by Nippon AEROSIL CO., LTD.) was added to 100 parts by mass of the obtained toner base particle, and the toner base particle and the silica were mixed to prepare "Toner 2".

Production Example 3

Preparation of Toner 3

—Synthesis of Organic Fine Particle Emulsion—

To a reaction vessel equipped with a stirrer and a thermometer, 683 parts by mass of water, 11 parts by mass of sodium salt of the sulfuric acid ester of methacrylic acid ethylene oxide adduct (ELEMINOL RS-30, manufactured by Sanyo Chemical Industries, Ltd.), 83 parts by mass of styrene, 83 parts by mass of methacrylic acid, 110 parts by mass of butyl acrylate, and 1 part by mass of ammonium persulphate were poured and stirred at 400 rpm for 15 minutes to obtain a white emulsion. The white emulsion was heated, the temperature in the system was raised to 75° C. and reacted for 5 hours. Next, 30 parts by mass of an aqueous solution of 1% ammonium persulphate was further added to the reaction vessel, and the reaction mixture was aged at 75° C. for 5 hours to obtain an aqueous dispersion liquid of a vinyl resin (copolymer of sodium salt of sulfate ester of methacrylic acid-butyl acrylate-methacrylic acid ethylene oxide adduct). This aqueous solution is referred to as [fine particle dispersion liquid 1].

The volume average particle diameter of the [fine particle dispersion liquid 1] was measured by a laser diffraction particle size distribution analyzer (LA-920, manufactured by HORIBA Instruments Inc.) and it was 105 nm. After drying a part of [fine particle dispersion liquid 1] and isolating only resin component. The resin component had a glass transition temperature (Tg) of 59° C. and a mass average molecular mass of 150,000.

—Preparation of Aqueous Phase—

To 990 parts by mass of water, 83 parts by mass of [fine particle dispersion liquid 1], 37 parts by mass of a 48.5% aqueous solution of sodium dodecyl diphenyl ether disulfonic acid (ELEMINOL MON-7, manufactured by Sanyo Chemical Industries, Ltd.) and 90 parts by mass of ethyl acetate were mixed and stirred together to obtain a milky liquid. This is referred to as [aqueous phase 1].

—Synthesis of Low-Molecular Polyester—

In a reaction vessel equipped with a condenser tube, a stirrer, and a nitrogen inlet tube, 229 parts by mass of bisphenol A ethylene oxide dimolar adduct, 529 parts by mass of bisphenol A propylene oxide trimolar adduct, 208 parts by mass of terephthalic acid, 46 parts by mass of adipic acid and 2 parts by mass of dibutyl tin oxide were poured, and the components were reacted under normal pressure at 230° C. for 8 hours, and then further reacted under a reduced pressure of 10 mmHg to 15 mmHg for 5 hours, then 44 parts by mass of anhydrous trimellitic acid was added to the reaction vessel, and the components were reacted under normal pressure at 180° C. for 2 hours to obtain [low molecular weight polyester 1].

The obtained [low molecular weight polyester 1] had a glass transition temperature (Tg) of 45° C., a mass average molecular mass of 5,800, a number average molecular mass (Mn) of 2,600, and an acid value of 24 mg/KOH/g.

—Synthesis of Polyester Prepolymer—

In a reaction vessel equipped with a condenser tube, a stirrer, and a nitrogen inlet tube, 682 parts by mass of bisphenol A ethylene oxide dimolar adduct, 81 parts of bisphenol A propylene oxide dimolar adduct, 283 parts by mass of terephthalic acid, 22 parts by mass of anhydrous trimellitic acid and 2 parts by mass of dibutyl tin oxide were poured, and the components were reacted under normal pressure at 230° C. for 8 hours and then further reacted under a reduced pressure of 10 mmHg to 15 mmHg for 5 hours to thereby obtain [intermediate polyester 1]. The obtained [intermediate polyester 1] had a number average molecular mass (Mn) of 2,100, a mass average molecular mass of 9,500, a glass transition temperature (Tg) of 55° C., an acid value of 0.5 mgKOH/g and a hydroxyl value of 51 mgKOH/g.

Next, in a reaction vessel equipped with a condenser, a stirrer, and a nitrogen inlet tube, 410 parts by mass of [intermediate polyester 1], 89 parts by mass of isophorondiisocyanate, and 500 parts by mass of ethyl acetate were poured, and the components were reacted at 100° C. for 5 hours to obtain [prepolymer 1].

The obtained [prepolymer 1] had a free isocyanate mass percent of 1.74% by mass.

—Synthesis of Ketimine—

Into a reaction vessel equipped with a stirrer and a thermometer, 170 parts by mass of isophorone diamine and 75 parts by mass of methylethylketone were poured, and the components were reacted at 50° C. for 5 hours to obtain [ketimine compound 1]. The amine value of [ketimine compound 1] was 418.

—Preparation of Masterbatch (MB)—

To 1,200 parts by mass of water, 540 parts of carbon black (PBk-7: PRINTEX 60 [DBP oil absorption=114 mL/100 mg, pH=10], manufactured by Degssa Co.), and 1,200 parts by mass of a polyester resin (RS801, manufactured by Sanyo Chemical Industries, Ltd.) were added and mixed in a HENSCHEL MIXER (manufactured by MITSUI MINING CO., LTD.). The obtained mixture was kneaded at 150° C. for 30 minutes using two rollers, extrusion-cooled and pulverized using a pulverizer to thereby obtain a masterbatch. This is referred to as [masterbatch 1].

—Preparation of Oil Phase—

In a reaction vessel equipped with a stirrer and a thermometer, 300 parts by mass of [low-molecular weight polyester 1], 90 parts by mass of carnauba wax, 10 parts by mass of rice wax, and 1,000 parts by mass of ethyl acetate were poured, and the components were dissolved at 79° C. with stirring and then quenched to a temperature of 4° C. at a stretch. Then, the components were dispersed three times using a bead mill (ULTRA VISCO MILL, manufactured by AIMEX CO., LTD.) under the conditions of a liquid feeding rate of 1 kg/hr, a disc circumferential rate of 6 m/sec and 80% by volume of a zirconia bead being packed. As a result, a wax dispersion liquid having a volume average particle diameter of 0.6 μm was obtained.

Next, 500 parts by mass of "masterbatch 1", and 640 parts by mass of 70% by mass of ethyl acetate solution were added, and the components were mixed for 10 hours and then dispersed 5 times using the bead mill, and ethyl acetate was added thereto to adjust the solid concentration of 50% by mass, thereby preparing "oil phase 1".

—Preparation of Polymerized Toner—

In a vessel, 73.2 parts by mass of [oil phase 1], 6.8 parts by mass of [prepolymer 1] and 0.48 parts by mass of [ketimine compound 1] were poured, the components were sufficiently mixed to prepare [emulsified oil phase 1]. To the [emulsified oil phase 1], 120 parts by mass of [aqueous phase 1] were added, the components were mixed in a homomixer for 1 minute and then converged while slowly stirring using a paddle for 1 hour to thereby obtain [emulsified slurry 1].

The solvent was removed from the obtained [emulsified slurry 1] at 30° C. for 1 hour, and the [emulsified slurry 1] was further aged for 5 hours at 60° C., washed, filtered and dried, then screened through a mesh with a pore size of 75 μm to thereby prepare a toner base particle having a volume average particle diameter of 6.1 μm, a number average particle diameter of 5.4 μm, an average circularity of 0.972.

Next, in a HENSCHEL MIXER, 0.7 parts by mass of a hydrophobic silica and 0.3 parts by mass of a hydrophobized titanium oxide were added to 100 parts by mass of the obtained toner base particle, and the components were mixed to thereby prepare "toner 3".

Example 1

Preparation of Carrier 1

Using an apparatus shown in FIG. 1, in a carrier treatment tank 110 (inner volume: 400 mL), 7 parts by mass of a silicone resin A (weight average molecular mass (Mw)=12,500, number average molecular mass (Mn)=6,500, Mw/Mn=1.92) and 100 parts by mass of a ferrite core material having a volume average particle diameter of 35 μm (saturated magnetic moment at 1 kg=65 emu/g) (surface area: 7.27 $m^2$) were put. A valve 3 was opened while stirring the components in the carrier treatment tank 110, carbon dioxide (purity=99.5%, manufactured by GASTEC SERVICE INC.) was supplied in the carrier treatment tank 110 using a pressurizing pump 1, a dissolution condition 1 (25 MPa, 15° C.) was set, and then the valve 3 was closed.

The inside of the carrier treatment tank 110 was kept at 25 MPa and 15° C. for 2 hours, then valves 5 and 6 were opened, the temperature of the inside of the carrier treatment tank 110 was increased to 40° C. while maintaining the pressure, and then the valves 5 and 6 were closed.

The inside of the carrier treatment tank 110 were kept at 25 MPa and 40° C. for 0.5 minutes, then the valves 5 and 6 were opened to restore the inside to the normal pressure range by means of a depressurizing pump 1 in 2 hours. Further, the inside of the carrier treatment tank 110 was heated at 160° C. for 2 hours, thereby preparing a carrier 1. A core material and a coating resin that had not been used could be collected from both the carrier treatment tank 110 and the raw material recycling tank 112 and recycled.

The average thickness of coating layer, standard deviation, and electric resistivity of the obtained carrier 1 were measured as follows. The obtained carrier 1 had a coating layer with an average thickness of 0.35 μm, a standard deviation of 0.04 and an electric resistivity, LogR, of 3.5 Ω·cm.

<Measurement of Average Thickness and Standard Deviation of Coating Layer in Carrier>

From the gravity center of a cross-section of the obtained carrier, eight radial lines in radial directions were drawn at each angle of 45 degrees, and the thickness of the coating layer was measured at eight intersection points with the carrier surface, the thickness of the coating layer was measured at 80 sites in total, and the average thickness and the standard deviation were calculated.

Figure 7:
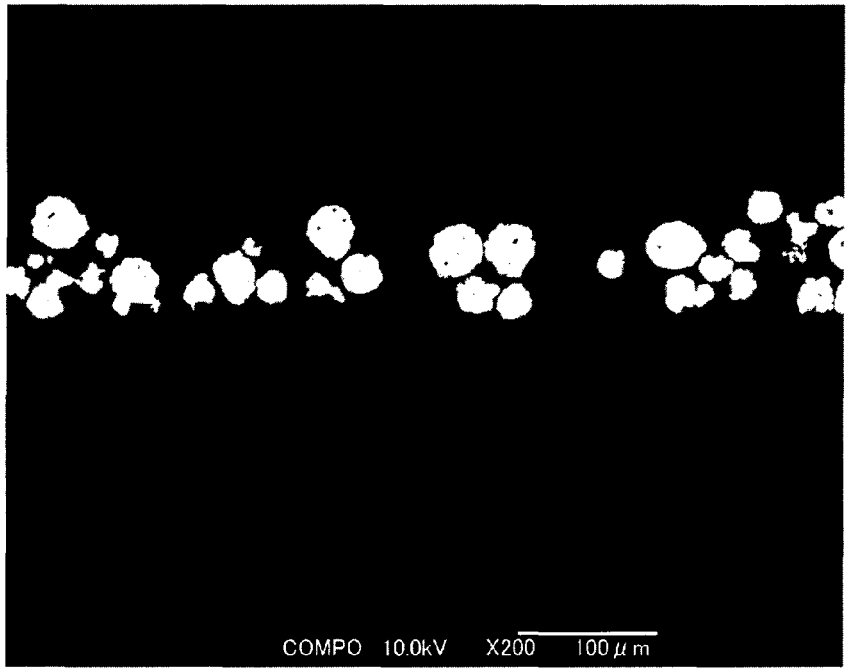
FIG. 7 is a cross-sectional SEM (Scanning Electron Microscopic) photograph of a carrier used to measure the thickness of a coating layer formed in the carrier.
Figure 8:
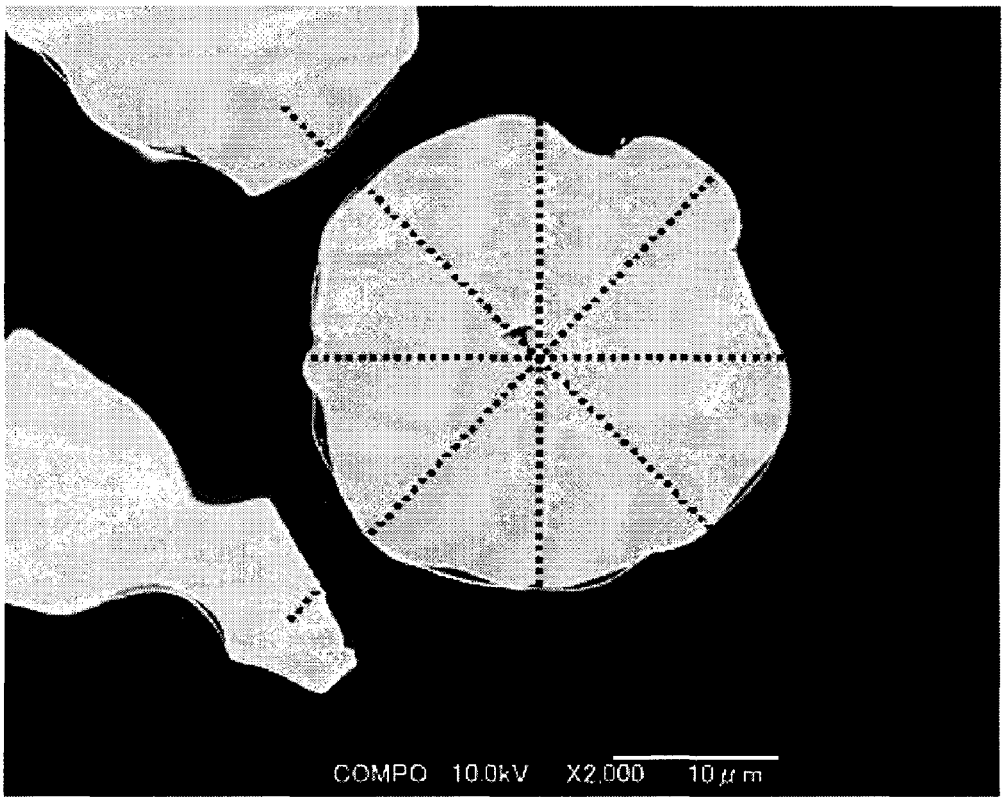
FIG. 8 is a cross-sectional SEM (Scanning Electron Microscopic) photograph showing the method of measuring the thickness of the coating layer formed in the carrier.

Specifically, as shown in FIG. 7, the carrier cross-section was micrographed at 2,000-fold magnification using a transmission electron microscope (S-4,200, manufactured by Hitach, Ltd.). From the obtained scanning electron microscope photographs of the carrier cross-section, 10 carriers were arbitrarily chosen. Then, as shown in FIG. 8, the gravity center of the cross-section of each of the chosen carriers, eight radial lines in radial directions were drawn at each angle of 45 degrees, and the thickness of the coating layer was measured for each of the carriers at eight intersection points with the each carrier surface, the average value of the coating layer was regarded as the thickness of the coating layer, and the standard deviation was calculated in the measurement at 80 sites in total.

<Measurement of Electric Resistivity of Carrier>

A vessel equipped with electrodes placed in parallel at 2 mm intervals was filled with each of the carriers, and a direct current resistivity with a potential difference of 50V between the electrodes was measured by using 4329A HIGH RESISTANCE METER manufactured by Hewlett-Packard Development Co., L.P.

Example 2

Preparation of Carrier 2

A carrier 2 was prepared in the same manner as in Example 1 except that a silicone resin B (weight average molecular mass (Mw)=18,000, number average molecular mass (Mn)=9,000, Mw/Mn=2.00) was used instead of the silicone resin A.

The average thickness of the coating layer in the obtained carrier 2 was measured in the same manner as in Example 1. The coating layer formed in the carrier 2 had an average thickness of 0.34 μm, a standard deviation of 0.04 and an electric resistivity, LogR, of 13.5 Ωcm.

Example 3

Preparation of Carrier 3

A carrier 3 was prepared in the same manner as in Example 1 except that the dissolution condition 1 (25 MPa, 15° C.) was changed to a dissolution condition 2 (7 MPa, 15° C.).

The average thickness of the coating layer in the obtained carrier 3 was measured in the same manner as in Example 1. The coating layer formed in the carrier 3 had an average thickness of 0.34 μm, a standard deviation of 0.05 and an electric resistivity, LogR, of 13.5 Ω·cm.

Example 4

Preparation of Carrier 4

A carrier 4 was prepared in the same manner as in Example 2 except that the dissolution condition 1 (25 MPa, 15° C.) was changed to a dissolution condition 2 (7 MPa, 15° C.).

The average thickness of the coating layer in the obtained carrier 4 was measured in the same manner as in Example 1. The coating layer formed in the carrier 4 had an average thickness of 0.36 μm, a standard deviation of 0.06 and an electric resistivity, LogR, of 13.6 Ω·cm.

Example 5

Preparation of Carrier 5

Using the apparatus shown in FIG. 1, in the carrier treatment tank 110 (inner volume: 400 mL), 7 parts by mass of a silicone resin A (weight average molecular mass (Mw)=12,500, number average molecular mass (Mn)=6,500, Mw/Mn=1.92) and 100 parts by mass of a ferrite core material having a volume average particle diameter of 35 μm (saturated magnetic moment at 1 k gauss=65 emu/g) (surface area: 7.27 $m^2$) were put. The valve 3 was opened while stirring the components in the carrier treatment tank 110, carbon dioxide (purity=99.5%, manufactured by GASTEC SERVICE INC.) was supplied in the carrier treatment tank 110 using the pressurizing pump 1, the dissolution condition 1 (25 MPa, 15° C.) was set, and then the valve 3 was closed.

The inside of the carrier treatment tank 110 was kept at 25 MPa and 15° C. for 2 hours, then the valves 5 and 6 were opened, the pressure of the inside of the carrier treatment tank 110 was reduced to a normal pressure by means of the depressurizing pump 1 in 2 hours, thereby preparing a carrier 5. A core material and a coating resin that had not been used could be collected from both the carrier treatment tank 110 and the raw material recycling tank 112 and recycled.

The average thickness of the coating layer in the obtained carrier 5 was measured in the same manner as in Example 1. The coating layer formed in the carrier 5 had an average thickness of 0.92 μm, a standard deviation of 0.08 and an electric resistivity, LogR, of 13.8 Ω·cm.

Preparation of Carrier 6

A carrier 6 was prepared in the same manner as in Example 1 except that a silicone resin C (weight average molecular mass (Mw)=8,000, number average molecular mass (Mn)=5,500, Mw/Mn=1.45, phase transition temperature from a solid phase=10° C.) was used instead of the silicone resin A.

The average thickness of the coating layer in the obtained carrier 6 was measured in the same manner as in Example 1. The coating layer formed in the carrier 6 had an average thickness of 0.36 μm, a standard deviation of 0.03 and an electric resistivity, LogR, of 13.5 Ω·cm.

Reference Example 1

Preparation of Reference Carrier 1

Using the apparatus shown in FIG. 1, in the carrier treatment tank 110 (inner volume: 400 mL), 7 parts by mass of a silicone resin A (weight average molecular mass (Mw)=12,500, number average molecular mass (Mn)=6,500, Mw/Mn=1.92) and 100 parts by mass of a ferrite core material having a volume average particle diameter of 35 μm (saturated magnetic moment at 1 k gauss=65 emu/g) (surface area: 7.27 $m^2$) were put. The valve 3 was opened while stirring the components in the carrier treatment tank 110, carbon dioxide (purity=99.5%, manufactured by GASTEC SERVICE INC.) was supplied in the carrier treatment tank 110 using the pressurizing pump 1, the dissolution condition 3 (20 MPa, 100° C.) was set, and then the valve 3 was closed.

The inside of the carrier treatment tank 110 was kept at 20 MPa and 100° C. for 2 hours, then the valves 5 and 6 were opened, then the valves 5 and 6 were opened to restore the inside to the normal pressure range by means of the depressurizing pump 1 in 2 hours. Further, the inside of the carrier treatment tank 110 was heated at 160° C. for 2 hours, thereby preparing a reference carrier 1. A core material and a coating resin that had not been used could be collected from both the carrier treatment tank 110 and the raw material recycling tank 112 and recycled.

The average thickness of the coating layer in the obtained reference carrier 1 was measured in the same manner as in Example 1. The coating layer formed in the reference carrier 1 had an average thickness of 0.21 μm, a standard deviation of 0.05 and an electric resistivity, LogR, of 12.6 Ω·cm.

Comparative Example 1

Preparation of Comparison Carrier 1

A dispersion liquid composed of 1,000 g of a toluene solution (concentration of solid parts=10% by mass) of (weight average molecular mass (Mw)=12,500, number average molecular mass (Mn)=6,500, Mw/Mn=1.92) and 5 g of a catalyst [$(CH_3)_2Sn(OCOCH_3)_2$] was applied over the surface of 5 kg of a ferrite core material having a volume average particle diameter of 35 μm (saturated magnetic moment at 1 k gauss=65 emu/g at a coating rate of 50 g/min for 20 minutes under an atmosphere of 100° C. using a coating device equipped with a rotatable bottom plate. The obtained ferrite particle coated with the silicone resin was heated at 200° C. for 1 hour to thereby prepare a comparison carrier 1.

The average thickness of the coating layer in the obtained comparison carrier 1 was measured in the same manner as in Example 1. The coating layer formed in the comparison carrier 1 had an average thickness of 0.35 μm, a standard deviation of 1.32 and an electric resistivity, LogR, of 13.5 Ω·cm.

The above-mentioned results demonstrated that the carriers of Examples 1 to 6 respectively had excellent adhesion property between the coating layer and the core material as compared to the comparison carrier 1 prepared in Comparative Example 1, because the carriers of Examples 1 to 6 respectively had a coating layer with a uniform thickness and had no peeled sites and no holes in the coating layer.

Examples 7 to 14, Reference Example 2 and Comparative Example 2

Preparation of Developer

The prepared carriers 1 to 6, reference carrier 1 and comparison carrier 1 were respectively combined to toners 1 to 3 as shown in the following Table 1 to thereby prepare individual developers of Examples 7 to 14, Reference Example 2 and Comparison Example 2 by a conventional method.

The image density, toner scattering, and background smear of the obtained individual developers were evaluated and then totally evaluated. Table 1 shows the evaluation results.

<Image Density>

In a tandem-type color image forming apparatus (IMAGIO NEO 450, manufactured by Ricoh Company Ltd.), using the obtained each developer, a solid image of 1.00 mg/$cm^2$±0.05 mg/$cm^2$ in adhesion amount of each of the developers was formed on copying paper (TYPE 6000 <70W> manufactured by Ricoh Company Ltd.). Formation of the solid image was repeatedly done on 1,000,000 sheets of the copying paper.

The image density of the obtained solid image was visually checked at the initial stage and after endurance test of outputting 1,000,000 sheets of copying paper, and the each of the developers was evaluated based on the following criteria. The higher image density, the better the quality of image. The evaluation of image density is supportive information for the image forming method of the present invention.

[Evaluation Criteria]

A: At the initial stage of the endurance test of outputting 1,000,000 sheets and after the endurance test, it was possible to obtain a high-quality image with no change in image density.

B: After the endurance test of outputting 1,000,000 sheets, it was possible to obtain a high-quality image, although the image density was slightly reduced.

C: After the endurance test of outputting 1,000,000 sheets, the image density lowered, and the quality of the image degraded.

D: After the endurance test of outputting 1,000,000 sheets, the image density remarkably lowered, and the quality of the image significantly degraded.

<Toner Scattering>

After continuously outputting 1,000,000 sheets of a 5% image-area ratio chart in a tandem-type color image forming apparatus (IMAGIO NEO 450, manufactured by Ricoh Company Ltd.), the level of toner contamination in the image forming apparatus was visually checked and evaluated at four ranks based on the following criteria.

[Evaluation Criteria]

A: No toner contamination was observed at all in the image forming apparatus, and an excellent state was maintained.

B: No toner contamination was observed in the image forming apparatus, and a satisfactory state was maintained.

C: Toner contamination was observed in the image forming apparatus, however, it was still on the practical level.

D: Tone contamination was severe in the image forming apparatus, and it was far from the practical level.

<Background Smear>

After continuously outputting 1,000,000 sheets of a 5% image-area ratio chart in a tandem-type color image forming apparatus (IMAGIO NEO 450, manufactured by Ricoh Company Ltd.), the level of background in the image forming apparatus was visually checked and evaluated at four ranks based on the following criteria.

[Evaluation Criteria]

A: No smear was observed on the image background.

B: Smear was observed on the image background.

C: Smear was clearly observed on the image background.

<Total Evaluation>

From the above-mentioned evaluation results, each of the developers was evaluated based on the following criteria.

[Evaluation Criteria]

A: Extremely excellent.

B: Excellent

C: Poor

TABLE 1

| | Carrier | Toner | Image density | Toner scattering | Back-ground smear | Total evalu-ation |
|---|---|---|---|---|---|---|
| Ex. 7 | Carrier 1 | Toner 3 | A | A | A | A |
| Ex. 8 | Carrier 1 | Toner 2 | A | A | A | A |
| Ex. 9 | Carrier 1 | Toner 1 | A | A | A | A |
| Ex. 10 | Carrier 2 | Toner 3 | A | B | A | B |
| Ex. 11 | Carrier 3 | Toner 3 | A | B | A | B |
| Ex. 12 | Carrier 4 | Toner 3 | A | B | A | B |
| Ex. 13 | Carrier 5 | Toner 3 | B | C | A | B |
| Ex. 14 | Carrier 6 | Toner 3 | A | A | A | A |
| Ref. Ex. 2 | Reference carrier 1 | Toner 3 | B | C | B | B |
| Compara. Ex. 2 | Compar-ison carrier 1 | Toner 3 | D | D | C | C |

The results shown in Table 1 demonstrated that the developers of Examples 7 to 14 using each of the carriers 1 to 6 prepared using a coating material that had been dissolved in carbon dioxide in a liquid state made it possible to obtain a high-image density without substantially causing toner scattering and background smear, as compared to the developer of Comparative Example 2.

In the method for producing a carrier of the present invention, a coating material is dissolved in carbon dioxide in a liquid state and then a coating layer is formed on the surface of the core material. Therefore, the method for producing a carrier of the present invention makes it possible to form a coating layer having an adhesion property with the core material and having a uniform thickness even with use of a resin that is poor in solubility, and also makes it possible to clear the regulation of volatile organic compounds (VOC) and to efficiently produce a latent electrostatic image developing carrier that has a high-mechanical strength and is excellent in toner chargeability and storage stability with time without the necessity of a substantial amount of dry energy.

The developer of the present invention contains the carrier of the present invention and a toner. By using the developer, a high-image density can be formed without substantially causing toner scattering and background smear.

The image forming method of the present invention allows for obtaining high-quality images with high-mechanical strength, high-sharpness and high-image density without substantially causing toner scattering and background smear. Therefore, the image forming method of the present invention can be favorably used for various electrophotographic image forming apparatuses.

What is claimed is:

1. A method for producing a carrier, comprising:

dissolving at least a coating material in carbon dioxide in a liquid state, and forming a coating layer with a thickness of from 0.34-1.0 μm on a core material surface by reducing the solubility of the liquid with at least the coating material dissolved therein through control of at least any one of the pressure and temperature.

2. The method for producing a carrier according to claim 1, wherein the pressure used in the dissolution is 7.38 MPa or more.

3. The method for producing a carrier according to claim 1, wherein in the formation of the coating layer, the carbon dioxide in a liquid state is changed to carbon dioxide in a supercritical or subcritical state.

4. The method for producing a carrier according to claim 1, wherein in the formation of the coating layer, the pressure is reduced to an atmospheric pressure.

5. The method for producing a carrier according to claim 1, wherein in the formation of the coating layer, the temperature of the liquid with at least the coating material dissolved therein is raised to 31° C. or more.

6. The method of claim 1, wherein the pressure in the dissolving step is from 8.0 MPa to 40.0 MPa.

7. The method of claim 1, wherein the temperature in the dissolving step is from −30° C. to 30° C.

8. The method of claim 1, wherein at least one selected from the group consisting of methane, ethane, propane, and ethylene is mixed with the carbon dioxide liquid.

9. The method of claim 1, wherein an entrainer is mixed with the carbon dioxide liquid.

10. The method of claim 9, wherein the entrainer is selected from the group consisting of methanol, ethanol, propanol, butanol, hexane, toluene, ethyl acetate, chloroform, dichloromethane, ammonia, melamine, urea, and thioethylene glycol.

11. The method of claim 1, comprising raising the temperature of the carbon dioxide in a liquid state with the coating material dissolved therein to a temperature equivalent to or higher than the supercritical temperature of carbon dioxide, and reducing a supercritical pressure to the atmospheric pressure.

12. The method of claim 1, wherein the coating material is at least one selected from the group consisting of an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and acryl monomer, a copolymer of vinylidene fluoride and vinyl fluoride, a fluoro terpolymer, and a silicone resin.

13. The method of claim 1, wherein the coating material is a straight silicone resins represented by the following Structural Formula (1)

Structural Formula (i)

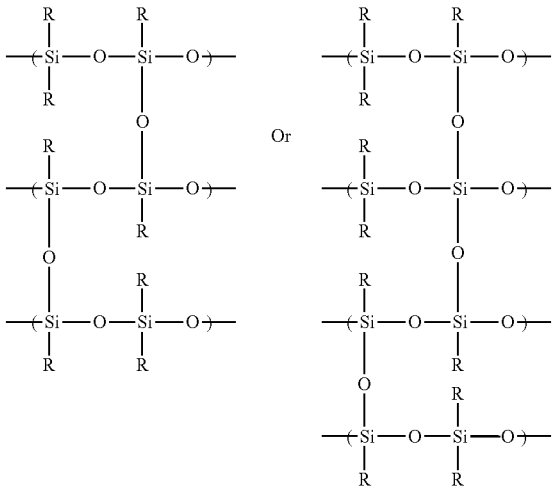

wherein R represents a hydrogen atom, a hydroxyl group, an alkoxy group, an alkyl group, an aryl group or an amino group.

14. The method of claim 1, wherein the coating material is a silicone resin which is in a solid state at 25° C. under normal pressure.

15. The method of claim 1, wherein the coating material is a silicone resin which has a silanol concentration of from 1% by mass to 40% by mass.

* * * * *